US006340255B1

(12) United States Patent
Konishi et al.

(10) Patent No.: US 6,340,255 B1
(45) Date of Patent: Jan. 22, 2002

(54) TAPE PRINTING METHOD TO ALLOW FOR REMOVAL OF EXCESS TAPE IN A BACKGROUND ENVIRONMENT

(75) Inventors: Yoshiharu Konishi; Hitoshi Hayama, both of Shioziri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/488,733

(22) Filed: Jan. 20, 2000

(30) Foreign Application Priority Data

Jan. 21, 1999 (JP) ..... 11-013615 P

(51) Int. Cl.[7] ..... B41J 3/42

(52) U.S. Cl. ..... 400/615.2; 400/76; 400/70; 400/61

(58) Field of Search ..... 400/615.2, 76, 400/70, 61

(56) References Cited

U.S. PATENT DOCUMENTS

| | | | | | |
|---|---|---|---|---|---|
| 5,409,317 | A | * | 4/1995 | Ueno et al. | 400/61 |
| 5,829,897 | A | * | 11/1998 | Murai | 400/615.2 |
| 5,913,624 | A | * | 6/1999 | Ikegami | 400/621 |
| 5,931,587 | A | * | 8/1999 | Hayama | 400/76 |
| 5,947,619 | A | * | 9/1999 | Kurashina et al. | 400/615.2 |
| 5,980,133 | A | * | 11/1999 | Nunokawa et al. | 400/61 |
| 6,062,750 | A | * | 5/2000 | Ueno et al. | 400/615.2 |
| 6,120,200 | A | * | 9/2000 | Watanabe et al. | 400/615.2 |

FOREIGN PATENT DOCUMENTS

| | | |
|---|---|---|
| JP | 7-40611 | 2/1995 |
| JP | 7-156477 | 6/1995 |
| JP | 8-169155 | 7/1996 |
| JP | 8-230175 | 9/1996 |

* cited by examiner

*Primary Examiner*—John S. Hilten
*Assistant Examiner*—Charles H. Nolan, Jr.
(74) *Attorney, Agent, or Firm*—Hogan & Hartson L.LP.

(57) ABSTRACT

The invention provides a tape printing apparatus and control method therefor. One of a blank image without any image to be printed, and a ground image providing at least one of a ground color of the tape and a background pattern is selectively set. A leading end-cutting operation for cutting the tape at a leading edge of the print image ting is carried out. The print image is printed by a main printing operation. A trailing end-cutting operation for cutting the tape at a trailing edge of the print image is carried out. If the ground image was set to the background image of an immediately preceding label formed last time, the leading end-cutting operation for a present label to be formed this time is carried out by cutting the tape at a position located at least a predetermined extra print length LA rearward of a leading edge of the tape at a distance of (LA=LAE+α, wherein LAE represents a predetermined trailing extra print length defined as a length of a portion which extends from a trailing edge of the printed portion and on which the ground image continuing from the background image has been printed by an extra printing operation during preparation of the immediately preceding label, and α represents a predetermined value of length equal to or larger than 0).

21 Claims, 18 Drawing Sheets

Pc
Pp
[SGS(Y)]
[BGS(Y)]

[BGS(Y)]
[AG(K)]
[BGE(Y)]
[SGE(Y)]

SGS(Y)
[AG(K)]
LAS

[AG(K)]
SGS(Y)
BGS(Y)

SGS(Y)
BGS(Y)
AG(K)
[AG(K)]
[BGE(Y)]
[SGE(Y)]

LD

Pc
Pp
[AG(K)] [BGE(Y)] [SGE(Y)]

BG(Y)
AG(K)
[BGE(Y)][SGE(Y)]

AG(K)
[SGE(Y)]

AG(K)
BGE(Y)
SGE(Y)

LAE

BGE(Y)
SGE(Y)

LAE
LD

FIG. 12

| PRINTING CONDITIONS | | | | PRINT CONTROL CONDITIONS | | | | | |
|---|---|---|---|---|---|---|---|---|---|
| | | | | LEADING END-CUTTING CONTROL | | | TRAILING END-CUTTING CONTROL | | |
| No | GROUND IMAGE SETTING ON/OFF | | LEADING BACKGROUND LENGTH (LEADING BLANK LENGTH) LBS | FIRST TAPE FEED LENGTH LT1 | FIRST PRINT LENGTH LP1 | LEADING END -CUTTING REQUIRED / NOT REQUIRED | SECOND PRINT LENGTH LP2 | SECOND TAPE FEED LENGTH LT2 | REFERENCE DIAGRAM |
| | PRESENT | LAST | | | | | | | |
| 1 | ON | — | — | 0 | LAS+LD | REQUIRED | LR-LD +LAE | LR-LAE | FIG. 13 |
| 2 | OFF | — | LD-LA>LBS | 0 | LD-LBS | | LR-LD (LR-LD -LBE) | LD (LD+LBE) | FIG. 14 |
| 3 | | ON | LD-LA≦LBS<LD | LA+LBS-LD | LD-LBS | | | | FIG. 15 |
| 4 | | | LD≦LBS | LA | 0 | | | | FIG. 16 |
| 5 | | OFF | LD>LBS | 0 | LD-LBS | | | | FIG. 17 |
| 6 | | | LD≦LBS | 0 | 0 | NOT REQUIRED | | | FIG. 18 |

Pc
RSGE
Pp
[SGS(Y)]
[BGS(Y)]
[AG(K)]
LA
LD
LAS
LBS

<LT1=0>

<LP1=LAS+LD>
SGS(Y)
BGS(Y)
AG(K)
[AG(K)]
[BGE(Y)]
[SGE(Y)]

<LEADING END-CUTTING>
AG(K)
BGE(Y)
SGE(Y)

<LP2=LR-LD+LAE>

<LT2=LD-LAE>
+
<TRAILING END-CUTTING>
BGE(Y)
SGE(Y)

Pc
RSGE
BGS(W)
Pp
〔AG(K)〕
〔BGE(W)〕
LA
LBS
LD

〈LT1=0〉

RSGE
〔BGE(W)〕
〈LP1=LD-LBS〉

BGS(W)
AG(K)
〔AG(K)〕
LBE
〔BGE(W)〕
〈LEADING END-CUTTING〉

AG(K)
BGE(W)
〈LP2=LR-LD〉
(LP2=LR-LD-LBE)

BGE(w)
〈LT2=LD〉
(LT2=LD+LBE)
+
〈TRAILING END-CUTTING〉

Pc
RSGE
BGS(W)
Pp
[BGS(W)]
[AG(K)]
[BGE(W)]
LA
LBS
LD

[AG(K)]
[BGE(W)]
<LT1=LA+LBS-LD>
RSGE
BGS(W)

<LP1=LD-LBS>
BGS(W)
AG(K)
[AG(K)]
[BGE(W)]

<LEADING END-CUTTING>
AG(K)
BGE(W)

<LP2=LR-LD>
(LT2=LR-LD-LBE)

<LT2=LD>
(LP2=LD+LBE)
+
<TRAILING END-CUTTING>
BGE(w)

Pc
RSGE
BGS(W)
Pp
[BGS(W)]
[AG(K)]
[BGE(W)]
LA
LBS
LD

[AG(K)]
[BGE(W)]
<LT1=LA>
RSGE
BGS(W)

<LP1=0>
RSGE
BGS(W)
[AG(K)]
[BGE(W)]

<LEADING END-CUTTING>
AG(K)

<LP2=LR-LD>
(LP2=LR-LD-LBE)
BGE(W)

<LT2=LD>
(LT2=LD+LBE)
+
<TRAILING END-CUTTING>
BGE(w)

Pc
Pp
BGS(W)
〔AG(K)〕
〔BGE(W)〕

LBS
LD
〔AG(K)〕
〔BGE(W)〕

〈LT1=0〉
BGS(W)

〈LP1=LD-LBS〉
BGS(W)
AG(K)
〔AG(K)〕
〔BGE(W)〕

〈LEADING END-CUTTING〉
AG(K)

〈LP2=LR-LD〉
(LP2=LR-LD-LBE)
BGE(w)

〈LT2=LD〉
(LT2=LD+LBE)
+
〈TRAILING END-CUTTING〉
BGE(w)

Pc
Pp
BGS(W)
[BGS(W)]
[AG(K)][BGE(W)]

<LT1=0>

<LP1=0>

<NO LEADING END-CUTTING>
AG(K)

<LP2=LR-LD>
(LP2=LR-LD-LBE)
BGE(w)

<LT2=LD>
(LT2=LD+LBE)
+
<TRAILING END-CUTTING>

TAPE PRINTING METHOD TO ALLOW FOR REMOVAL OF EXCESS TAPE IN A BACKGROUND ENVIRONMENT

BACKGROUND OF THE INVENTION

1. Field of the Invention

This invention relates to a tape printing apparatus which is capable of producing a label by printing a print image on a tape and cutting off the printed portion from the tape and to a method of controlling the tape printing apparatus.

2. Prior Art

Conventionally, in a tape printing apparatus, an image formed e.g. by characters (letters, numerals, symbols, simple figures, etc.) (i.e. a character image) is printed as a main image on a tape having a predetermined ground color or a predetermined background pattern printed thereon, and then the printed portion is cut off from the tape at desired margins arranged forward and rearward of the printed portion, whereby a cut tape (i.e. a so-called label) having the ground color or background pattern of the tape as a background image for the main image can be produced. Therefore, if various tapes each having a different ground color or background pattern thereon are provided, and a main image is printed on the respective tapes, it is possible to produce labels having various ground colors or background patterns as their own background images. Alternatively, by employing a method of printing a print image including a main image and a background image on a tape to provide a ground image, such as a ground color or a background pattern, on the tape (to make the tape appear to have its own background image), and cutting the tape at respective leading and trailing edges of the printed portion, it is also possible to produce labels having various ground colors or background patterns as their own background images.

However, in the former method, it is required to provide as many kinds of tapes as the kinds of background images. On the other hand, in the latter method, it is only required to provide one kind of tape (e.g. of white color), but if the tape is not cut with accuracy at respective leading and trailing edges of the printed image, a ground color (e.g. white color) of the tape may remain on cut ends portions of a produced label, which takes a user an extra amount of time and labor for cutting the portions from the label e.g. by the use of scissors.

SUMMARY OF THE INVENTION

It is an object of the invention to provide a tape printing apparatus which is capable of printing a print image composed of a main image and a background image forming the background of the main image, on a tape, such that the background image makes the tape appear to have a ground image, such as a ground color of the tape and a background pattern, of its own, or otherwise reducing waste of the tape when no ground image is provided, and at the same time capable of forming labels which are printed beautifully up to cut edges, even if the accuracy of cutting position control is not so high, and a control method therefor.

To attain the above object, according to a first aspect of the invention, there is provided a method of controlling a tape printing apparatus that prints a print image composed of a main image and a background image forming a background of the main image, on a tape which is a printing object, and cuts off a printed portion of the tape on which the print image is printed to thereby form a label.

The method is characterized by comprising the steps of:

selectively setting one of a blank image without any image to be printed, and a ground image providing at least one of a ground color of the tape and a background pattern of the tape, to the background image;

carrying out a leading end-cutting operation for cutting the tape at a leading edge of the print image;

printing the print image by a main printing operation; and carrying out a trailing end-cutting operation for cutting the tape at a trailing edge of the print image, wherein when the ground image was set to the background image of an immediately preceding label formed last time, the leading end-cutting operation for a present label to be formed this time is carried out by cutting the tape at a position located at least a predetermined extra print length LA rearward of a leading edge of the tape ($LA=LAE+\alpha$, wherein LAE represents a predetermined trailing extra print length defined as a length of a portion which extends from a trailing edge of the printed portion and on which the ground image continuing from the background image has been printed by an extra printing operation during preparation of the immediately preceding label, and $\alpha$ represents a predetermined value of length equal to or larger than 0).

According to the method of controlling a tape printing apparatus, a print image composed of a main image and a background image is printed on a tape which is a printing object, and a leading end-cutting operation for cutting the tape at the leading edge of the print image and a trailing end-cutting operation for cutting the tape at the trailing edge of the print image are carried out to form a label on which the print image is printed. In addition to a blank image without any image to be printed, a ground image providing at least a ground color or a background pattern (to make the tape appear to have the ground color or the background pattern of its own) can be set to the background image. Therefore, one kind of tape (e.g. plain tape having white color) can serve the purpose of providing labels having various colors. Further, when the ground color is set to the background image, the ground image is printed from the trailing edge of the print image to a position the trailing extra print length LAE rearward of the trailing edge of the print image, by an extra printing operation, and then the trailing end-cutting operation is carried out at the trailing edge of the print image. That is, after printing an extra portion up to the position the railing extra print length LAE further rearward, the leading end-cutting operation is carried out. This makes it possible to obtain a label on which the ground color is neatly printed up to the very edge of the trailing cut end of the label even if the position of the trailing cut edge is not so accurate.

Further, according to this method, when the ground image was set to the background image of the immediately preceding label, for preparation of the present label, the leading end-cutting operation is carried out at a position the predetermined extra print length LA rearward of the leading edge of the tape ($LA=LAE+\alpha$, where $\alpha$ is a predetermined value of length which is equal to or larger than "0"). This makes it possible to prevent the ground image printed by the immediately preceding label-forming process from remaining until after the leading end-cutting process in the present label-forming operation. It should be noted that the predetermined value a may be set, allowing for a tolerance (margin of error) of the cutting position. For instance, even if the cutting position Pc for the leading end-cutting operation is not so accurate, so long as the predetermined value $\alpha$ is set to a value which is slightly larger than the tolerance of the cutting position Pc, it is possible to prevent the ground image printed by the immediately preceding label-forming process from remaining. In short, even when a blank image is set to the background image in the present label-forming process, it is possible to obtain a label which looks neat up to the leading cut edge thereof. Therefore, the method of controlling the tape printing apparatus is capable of printing the print image composed of the main image and the background image on the tape, and thereby providing the ground image, such as the ground color of the tape or the background pattern, on the tape, as well as obtaining a label which looks neat up to the cut edges thereof even if the cutting position is not so accurate.

Preferably, if the ground image is set to the background image of the present label, the ground image is printed from a position located leading extra print length LAS forward of the leading edge of the print image to the leading edge of the print image, in a manner continuing to the background image, by the extra printing operation, and then the leading end-cutting operation is carried out to cut the tape at the leading edge of the print image.

According to this preferred embodiment, if the ground is set to the background image of the print image of the present label, the ground image is printed from a position located the leading extra print length LAS forward of the leading edge of the print image to the leading edge of the print image, in a manner continuing to the background image, by the extra printing operation, and then the leading end-cutting operation is carried out to cut the tape at the leading edge of the print image. That is, the leading end-cutting operation is carried out after printing the ground image by the extra printing operation from the position located leading extra print length LAS forward of the leading edge of the print image. Therefore, even if the accuracy of the cutting position is not so high, it is possible to obtain a label which looks neat up to the leading cut edge thereof. It should be noted that the leading extra print length LAS can be made equal to the trailing extra print length (by setting LAS=LAE) or can be set arbitrarily and separately.

Preferably, the tape printing apparatus includes a print head located at a printing position for carrying out printing on the tape by using ink, a feeder device for feeding the tape in a downstream direction, and a cutter located at a cutting position ahead-to-cutter distance LD downstream of the printing position of the print head, for cutting the tape, and the method includes the steps of setting print control conditions for control of printing of the print image, based on predetermined printing conditions including a condition of whether the ground image has been set to the background image of the present label, and controlling operation of the feeder device and operation of the print head, based on print image data representative of the print image and the print control conditions, to carry out feeding of the tape and various printing operations including the main printing operation and the extra painting operation, and at the same time controlling operation of the cutter to carryout various cutting operations including the leading end-cutting operation and the trailing end-cutting operation.

According to this preferred embodiment, the print control conditions for control of printing of the print image are set based on the predetermined printing conditions including a condition of whether the ground image has been set to the background image of the present label, and operation of the feeder device and operation of the print head are controlled based on print image data representative of the print image and the print control conditions, to carry out feeding of the tape and various printing operations including the main printing operation and the extra painting operation, and at the same time operation of the cutter located at a cutting position a head-to-cutter distance LD downstream of the printing position of the print head is controlled to carry out various cutting operations including the leading end-cutting operation and the trailing end-cutting operation. That is, by controlling the operation of the print means for carrying out the feeding of the tape and the cutter for carrying out various cutting operations, it is possible to obtain the above advantageous effects of the present invention.

To attain the above object, according to a second aspect of the invention, there is provided a tape printing apparatus for printing a print image composed of a main image and a background image forming a background of the main image, on a tape which is a printing object, by a main printing operation, and carrying out a leading end-cutting operation for cutting the tape at a leading edge of the print image and a trailing end-cutting operation for cutting the tape at a trailing edge of the print image to thereby form a label on which the print image is printed.

The tape printing apparatus according to the second aspect of the invention is characterized by comprising:

- a print head located at a printing position for carrying out printing on the tape by using ink;
- print means for causing the print head to carry out the printing while feeding the tape in a downstream direction;
- a cutter located at a cutting position ahead-to-cutter distance LD downstream of the printing position of the print head, for cutting the tape;
- background image-setting means for selectively setting one of various kinds of images including a blank image without any image to be printed, and a ground image providing at least one of a ground color of the tape and a background pattern of the tape, to the background image;
- print control condition-setting means for setting print control conditions for control of printing of the print image, based on predetermined printing conditions including a condition of whether the ground image is set to the background image;
- storage means for storing print image data representative of the print image; and
- print control means for controlling the print means based on the print image data and the print control conditions such that the print means carries out various printing operations including the main printing operation, and controlling the cutter such that the cutter carries out various cutting operations including the leading end-cutting operation and the trailing end-cutting operation, wherein if the ground image is set to the background image of a present label to be formed this time, the print control means controls the print means such that the ground image is printed from a position located a leading extra print length LAS forward of the leading edge of the print image to the leading edge of the print image, in a manner continuing to the background image, by an extra printing operation, and then controls the cutter such that the leading end-cutting operation is carried out at the leading edge of the print image, as well as controls the print means such that the ground image is printed by the extra printing operation from a trailing edge of the print image over a predetermined trailing extra print length LAE, and then controls the cutter such that the trailing end-cutting operation is carried out at the trailing edge of the print image, and wherein if the ground image was set to the background image of an immediately preceding label formed last time, the print control means controls the cutter such that the leading end-cutting operation is carried out for the present label by cutting the tape at a position located at least an extra print length LA rearward of the leading edge of the tape (LA=LAE+α, wherein α represents a predetermined value of length equal to or larger than 0).

According to this tape printing apparatus, the print image composed of the main image and the background image is printed on the tape which is the printing object by the main printing operation, and the leading end-cutting operation for cutting the tape at the leading edge of the print image and the trailing end-cutting operation for cutting the trailing edge of the print image are carried out to form a label on which the print image is printed. According to this tape printing apparatus, one of various kinds of images including a blank image without any image to be printed, and a ground image providing at least one of a ground color of the tape and a background pattern is selectively set to the background image. Therefore, one kind of tape (e.g. plain tape having white color) can serve the purpose of providing labels having various colors. Further, the print control conditions for control of the printing of the print image are set based on the predetermined printing conditions including a condition of whether the ground image is set to the background image, and based on the print image data representative of the print image and the print control conditions, the print means is controlled to thereby carry out various printing operations including the main printing operation and the cutter is controlled to carry out various cutting conditions including the leading end-cutting operation and the trailing end-cutting operation.

If the ground color is set to the background image of the present label, the ground image is printed from the position located the leading extra print length LAS forward of the leading edge of the print image to the leading edge of the print image, in a manner continuing to the background image, by the extra printing operation, and then the leading end-cutting operation is carried out at the leading edge of the print image. Further, the ground image is printed by the extra printing operation from the trailing edge of the print image over the predetermined trailing extra print length LAE, and then the trailing end-cutting operation is carried out at the trailing edge of the print image. In this case, the leading end-cutting operation is carried out after printing the ground image from the position located the leading extra print length LAS forward of the leading edge of the print image. This makes it possible to obtain a label on which the ground color is neatly printed up to the very edge of the leading cut end of the label even if the position of the leading cut edge is not so accurate.

Further, the trailing end-cutting operation is carried out after printing the ground image from the trailing edge of the print image up to the position located the trailing extra print length LAE rearward of the leading edge of the print image. This makes it possible to obtain the label on which the ground color is neatly printed up to the very edge of the trailing cut end of the label even if the position of the trailing cut edge is not so accurate. It should be noted that the leading extra print length LAS and the trailing extra print length LAE may be uniformly set (LAS=LAE), or otherwise may be set individually or separately.

Further, according to this tape printing apparatus, if the ground image was set to the background image of the immediately preceding label, when the present label is formed, the leading end-cutting operation is carried out at the position the predetermined extra print length LA rearward of the leading edge of the tape (LA=LAE+α, where α is the predetermined value of length which is equal to or larger than "0"). This makes it possible to prevent the ground image printed by the immediately preceding label-forming process from remaining until after the leading end-cutting operation in the present label-forming process. It should be noted that the predetermined value α may be set, allowing for a tolerance (margin of error) of the cutting position. For instance, even if the cutting position Pc for the leading end-cutting operation is not so accurate, so long as the predetermined value a is set to a value which is slightly larger than the tolerance of the cutting position Pc, it is possible to prevent the ground image printed by the immediately preceding label-forming process from remaining. In short, even when the blank image is set to the background image in the present label-forming process, it is possible to obtain a label which looks neat up to the leading cut edge thereof. Therefore, the tape printing apparatus is capable of printing the print image composed of the main image and the background image on the tape, and thereby providing the ground image, such as the ground color of the tape or the background pattern, on the tape, to make the tape appear to have the ground color or the background pattern of its own, as well as obtaining a label which looks neat up to the leading cut edge thereof even if the cutting position is not so accurate.

More preferably, the step of controlling the operation of the feeder device and the operation of the print head and at the same time controlling the operation of the cutter includes the steps of carrying out a leading end-cutting control process such that the leading edge of the tape coincides with the leading edge of the label at the cutting position of the cutter when the leading end-cutting operation is carried out, and carrying out a trailing end-cutting control process for execution of the trailing end-cutting operation, after the leading end-cutting operation.

Preferably, the print control means comprises leading end-cutting process control means for carrying out a leading end-cutting control process such that the leading edge of the tape coincides with the leading edge of the label at the cutting position of the cutter when the leading end-cutting operation is carried out, and trailing end-cutting process control means for carrying out a trailing end-cutting control process for execution of the trailing end-cutting operation, after the leading end-cutting operation.

In general, the so-called leading end-cutting operation is an operation for cutting the tape at the leading edge of a label to be formed. Therefore, after the leading end-cutting operation is carried out, the leading edge of the label to be formed and the leading edge of the tape cut by the cutter coincide with each other. Conversely, when these ends coincide with each other from the beginning, the leading end-cutting operation can be omitted. That is, in the present invention, the term "the leading end-cutting control process" is used to include the control of omitting the leading end-cutting operation. According to present tape printing apparatus and method of controlling the same, the leading end-cutting control process is carried out until the leading edge of the label to be formed and the leading cut edge of the tape comes to coincide with each other, and after termination of the leading end-cutting control process, the trailing end-cutting control process is carried out. Therefore at the start of the trailing end-cutting control process, the leading end of the label to be formed and the leading cut edge of the tape cut by the cutter coincide with each other. In this state, the length of the head-to-cutter distance LD out of the label length LR (i.e. the length of the print image) is already downstream of the printing position of the print head. That is, it is only required to provide (prepare) a portion of LD out of the label length (print image length) LR by the leading end-cutting control process, and provide (prepare) a portion of LR−LD by the trailing end-cutting control process. Thus, the two control processes can be handled separately.

More preferably, the step of carrying out the leading end-cutting control process comprises the steps of carrying out a first tape-feeding operation by feeding the tape in the downstream direction by a first tape feed length LT1 (LT1 0) without executing printing or while printing the blank image, carrying out a first printing operation by feeding the tape in the downstream direction by a first print length LP1 (LP1 0) while executing printing, after the first tape feeding operation, and carrying out the leading end-cutting operation after the first printing operation, wherein the print control conditions include the first tape feed length LT1 and the first print length LP1.

Preferably, the leading end-cutting process control means comprises first tape-feeding control means for controlling the print means such that the print means carries out a first tape-feeding operation by feeding the tape in the downstream direction by a first tape feed length LT1 (LT1 0) without executing printing or while printing the blank image, first print control means for controlling the print means such that the print means carries out a first printing operation by feeding the tape in the downstream direction by a first print length LP1 (LP1 0) while executing printing after the first tape feeding operation, and leading end-cutting control means for controlling the cutter such that the cutter carries out the leading end-cutting operation, after the print means carries out the first printing operation, wherein the print control conditions include the first tape feed length LT1 and the first print length LP1.

According to this tape printing apparatus and control method therefor, the first tape-feeding operation is carried out by feeding the tape in the downstream direction by the first tape feed length LT1(LT1 0) without executing printing or while printing the blank image. After the first tape feeding operation, the first printing operation is carried out by feeding the tape in the downstream direction by the first print length LP1 (LP1 0) while executing printing. After the print means carries out the first printing operation, the leading end-cutting operation is carried out. In this case, the print control conditions include the first tape feed length LT1 and the first print length LP1. Therefore, the above control process can be easily carried out. That is, it is only required that the first tape-feeding operation and the first printing operation are carried out by the first tape feed length LT1 and the first print length LP1, respectively. It should be noted that the first tape-feeding operation may be carried out by feeding the tape, or otherwise by printing the blank image to thereby actually (eventually) carry out no printing operation.

Further, in this case, the first print length LT1 0, which includes a case of the LT1=0, and therefore, if the first tape feed length LT1 is set to 0, even when the first printing operation is directly carried out from the leading edge of the tape, an identical control mode can manage the two cases. Therefore, according to the tape printing apparatus and control method therefore, even when predetermined printing conditions including the condition of whether the ground image is set to the background image are different, by setting print control conditions for control of printing of the printing image based on the printing conditions, the same control mode can handle the different conditions.

Further preferably, the step of carrying out the leading end-cutting control process includes determining whether or not the present label requires the leading end-cutting operation, and omitting the leading end-cutting operation when it is determined that the present label does not require the leading end-cutting operation.

More preferably, the leading end-cutting process control means includes leading end-cutting omission-determining means for determining whether or not the present label requires the leading end-cutting operation and means for omitting the leading end-cutting control process when it is determined that the present label does not require the leading end-cutting operation.

According to these preferred embodiments, it is determined whether or not the present label requires the leading end-cutting operation, and when not required, the leading end-cutting control process is omitted. This shortens the whole processing time. Further, in general, the leading edge of the tape at the start of forming of the present label is in the state resulting from the trailing end-cutting operation for the immediately preceding label (i.e. located at the cutting position). Therefore, if the first tape feed length LT1=first print length LP1=0, it can be determined that the leading end-cutting operation is not required. In other words, in the case of the first tape feed length LT1=first print length LP1=0, there do not result any adverse effects even if the first printing operation and the leading end-cutting operation are carried out, but the leading end-cutting operation produces no results. However, by omitting these operations, the processing time can be shortened.

Further preferably, the step of carrying out the trailing end-cutting control process comprises the steps of carrying out a second printing operation by feeding the tape in the downstream direction by a second print length LP2(LP2 0) while executing printing, after termination of the leading end-cutting control process; carrying out a second tape-feeding operation by feeding the tape in the downstream direction by a second tape feed length LT2 (LT2 0) without executing printing or while printing the blank image, after the second printing operation; and carrying out the trailing end-cutting operation after the second tape-feeding operation, wherein the print control conditions include the second print length LP2 and the second tape feed length LT2.

More preferably, the trailing end-cutting process control means comprises second print control means for controlling the print means such that the print means carries out a second printing operation by feeding the tape by a second print length LP2 (LP2 0) in the downstream direction while executing printing, after termination of the leading end-cutting control process by the leading end-cutting process control means; second tape-feeding control means for controlling the print means such that the print means carries out a second tape-feeding operation by feeding the tape in the downstream direction by a second tape feed length LT2 (LT2 0) without executing printing or while printing the blank image, after the second printing operation; and trailing end-cutting control means for controlling the cutter such that the cutter carries out the trailing end-cutting operation after the print means carries out the second tape-feeding operation, wherein the print control conditions include the second print length LP2 and the second tape feed length LT2.

According to these preferred embodiments, the second printing operation is carried out carrying out by feeding the tape in the downstream direction by the second print length LP2(LP2 0) while executing printing, after termination of the leading end-cutting control process. The second tape-feeding operation is carried out by feeding the tape in the downstream direction by the second tape feed length LT2 (LT2 0) without executing printing or while printing the blank image, after the second printing operation. The trailing end-cutting operation is carried out after the second tape-feeding operation. In this case, the print control conditions include the second print length LP2 and the second tape feed length LT2. Therefore, the above control process can be easily carried out, since it is only required that the second printing operation and the second tape-feeding operation are carried out by the second print length LP2 and the second tape feed length LT2, respectively. It should be noted that, the second tape-feeding operation may be carried out by feeding the tape, or otherwise, by printing the blank to thereby actually (eventually) carry out no printing operation.

Further, since the cases of the second print length LP2=0, and the second tape feed length LT2=0 are included, even when these operations are not required, only by setting these lengths to 0 as corresponding ones of the print control conditions, an identical control mode can manage such cases. Therefore, according to the tape printing apparatus and control method therefore, even when the predetermined printing conditions including the condition of whether the ground image is set to the background image are different, by setting print control conditions for control of printing of the printing image based on the predetermined printing conditions, the same control mode can handle the different conditions.

Further preferably, the step of carrying out the trailing end-cutting control process includes, if the ground image is set to the background image of the present label, carrying out the main printing operation over a length of LR−LD after termination of the leading end-cutting control process, assuming that LR represents a print image length defined as a length of the print image, then carrying out the extra printing operation over the trailing extra print length LAE, then feeding the tape by a length of LD−LAE, and then carrying out the trailing end-cutting operation.

More preferably, if the ground image is set to the background image of the present label, the trailing end-cutting process control means controls the print means such that the print means carries out the main printing operation over a length of LR−LD after termination of the leading end-cutting control process by the leading end-cutting process control means, assuming that LR represents a print image length defined as a length of the print image, then carries out the extra printing operation over the trailing extra print length LAE, and then feeds the tape by a length of LD−LAE, and controls the cutter such that the cutter then carries out the trailing end-cutting operation.

According to these preferred embodiments, if the ground image is set to the background image of the present label, according to the trailing end-cutting control process, assuming that LR represents the print image length defined as the length of the print image, after the main printing operation is carried out over the length of LR−LD after termination of the leading end-cutting control process by the leading end-cutting process control, and the extra printing operation is carried out over the trailing extra print length LAE (=LR−LD+LAE=LP2), the tape is fed by the length of LD−LAE (=LT2), followed by carrying out the trailing end-cutting operation. This makes it possible to first print the ground image from the trailing edge of the print image to the position located the trailing extra print length LAE rearward of the trailing edge of the print image in a manner continuing from the background image by the extra printing operation, and then cut the tape at the trailing edge of the print image. As a result, even if the cutting position of the trailing end-cutting operation is not so accurate, it is possible to obtain a label in which the ground image is neatly printed up to the trailing cut edge of the label.

Further preferably, the step of carrying out the trailing end-cutting control process includes, if the blank image is set to the background image of the present label, carrying out the main printing operation over a length of LR−LD after termination of the leading end-cutting control process, assuming that LR represents a print image length defined as a length of the print image, then feeding the tape by a length of LD, and then carrying out the trailing end-cutting operation.

More preferably, if the blank image is set to the background image of the present label, the trailing end-cutting process control means controls the print means such that the print means carries out the main printing operation over a length of LR−LD after termination of the leading end-cutting control process by the leading end-cutting process control means, assuming that LR represents a print image length defined as a length of the print image, and then feeds the tape by a length of LD, and the trailing end-cutting process control means controls the cutter such that the cutter then carries out the trailing end-cutting operation.

According to these preferred embodiments, when the blank image is set to the background image of the present label, according to the trailing end-cutting control process, assuming that LR represents the print image length defined as the length of the print image, the main printing operation is carried out over the length of LR−LD (=LP2) after termination of the leading end-cutting control process, and the tape is fed by the length of LD (=LT2), and then the trailing end-cutting operation is carried out. As described above, at the start of the trailing end-cutting control process, the leading edge of the label to be formed and the cut position of the cutter coincide with each other, and the length of the head-to-cutter distance LD out of the label length LR (i.e. the length of the print image) is already downstream of the printing position of the print head. Therefore, by carrying out the main printing operation over a length of LR−LD (=LP2), printing of the whole print image is completed. Further, when the main printing operation is completed, the trailing edge of the print image is at the printing position for printing by the print head, and hence after termination of the main printing operation, by feeding the tape by the length LD (LT2), the trailing edge of the print image comes to the cutting position for cutting by the cutter. Therefore, by cutting the tape in this state, it is possible to cut the tape at the trailing edge of the print image. That is, by the above control process, all the process of printing (main printing operation) of the desired print image can be completed, and at the same time, the trailing end-cutting operation can be carried out to cut the tape at the trailing edge of the print image.

Further preferably, the step of carrying out the trailing end-cutting control process includes, if the blank image is set to the background image of the present label, carrying out the main printing operation over a length of LR−LD−LBE after termination of the leading end-cutting control process, assuming that LR represents a print image length defined as a length of the print image, and LBE represents a trailing blank length defined as a length of the blank image extending from the trailing edge of the main image to the trailing edge of the print image, then feeding the tape by a length of LD+LBE, and then carrying out the trailing end-cutting operation.

More preferably, if the blank image is set to the background image of the present label, the trailing end-cutting process control means controls the print means such that the print means carries out the main printing operation over a length of LR−LD−LBE after termination of the leading end-cutting control process by the leading end-cutting process control means, assuming that LR represents a print image length defined as a length of the print image and LBE represents a trailing blank length defined as a length of the blank image extending from the trailing edge of the main image to the trailing edge of the print image, and then feeds the tape by a length of LD+LBE, and controls the cutter such that the cutter then carries out the trailing end-cutting operation.

According to these preferred embodiments, if the blank image is set to the background image of the present label, assuming that LR represents the print image length defined as the length of the print image and LBE represents the trailing blank length defined as the length of the blank image extending from the trailing edge of the main image to the trailing edge of the print image, the main printing operation is carried out over the length of LR−LD−LBE (=LP2) after termination of the leading end-cutting control process, and then the tape is fed by a length of LD+LBE (=LT2), followed by carrying out the trailing end-cutting operation. As describe above, at the start of the trailing end-cutting control process, the length of the head-to-cutter distance LD out of the print image length LR is already downstream of the printing position of the print head. Therefore, assuming that LBE represents the length of the trailing blank length, after termination of the leading end-cutting control process, by carrying out the main printing operation (printing of the print image) over the length of LR−LD−LBE (=LP2), printing of the whole print image is completed. Further, at this time, the trailing edge of the main image comes to the cutting position. Therefore, by feeding the tape by the length of LD+LBE (=LT2), the trailing edge of the print image comes to coincide with the cutting position. Therefore, by cutting the tape in this state, it is possible to cut the tape at trailing edge of the print image. That is, by the above control processes, the whole printing (main printing operation) of the desired print image can be completed while omitting printing of the blank image, and at the same time, the trailing end-cutting operation can be carried out to cut the tape at the trailing edge of the print image.

Further preferably, the step of carrying out the leading end-cutting control process includes, if the ground image is set to the background image of the present label, carrying out the extra printing operation over the leading extra print length LAS then carrying out the main printing operation over a length of the head-to-cutter distance LD from the leading edge of the print image, and then carrying out the leading end-cutting operation.

More preferably, if the ground image is set to the background image of the present label, the leading end-cutting process control means controls the print means such that the print means carries out the extra printing operation over the leading extra print length LAS, and then carries out the main printing operation over a length of the head-to-cutter distance LD from the leading edge of the print image, and controls the cutter such that the cutter then carries out the leading end-cutting operation.

According to these preferred embodiments, if the ground image is set to the background image of the present label, the extra printing operation is carried out over the leading extra print length LAS, and then the main printing operation is carried out over a length of the head-to-cutter distance LD (LT1=0, and LP1=LAS+LD) from the leading edge of the print image, followed by carrying out the leading end-cutting operation. This makes it possible to first print the ground image from the position located the leading extra print length LAS forward of the trailing edge of the print image to the leading edge of the print image in a manner continuing to the background image, by the extra printing operation, and then cut the tape at the leading edge of the print image. As a result, even if the cutting position of the leading end-cutting operation is not so accurate, it is possible to obtain a label in which the ground image is neatly printed up to the leading cut edge of the label. It should be noted that in general, the required extra print length LA for preparation of the neat cut edges may be smaller than the head-to-cutter distance LD, and hence, in the above case, by only setting LA LD, irrespective of whether the ground image was set to the background image of the immediately preceding label, when the present label is prepared, the leading end-cutting operation is carried out at the position the extra print length LA rearward of the leading edge of the tape.

Further preferably, the step of controlling the operation of the feeder device and the operation of the print head and at the same time controlling the operation of the cutter includes omitting the main printing operation over a leading blank length LBS defined as a length of the blank image extending from a leading edge of the print image to the leading edge of the main image, if the blank image is set to the background image of the present label.

More preferably, if the blank image is set to the background image of the present label, the print control means omits the main printing operation over a leading blank length LBS defined as a length of the blank image extending from the leading edge of the print image to the leading edge of the main image.

According to these preferred embodiments, if the blank image is set to the background image of the present label, the main printing operation over the leading blank length LBS defined as the length of the blank image extending from the leading edge of the print image to the leading edge of the main image is omitted by the print control. That is, if the blank image is set to the background image of the present label, a portion of the print image from the leading edge thereof to the leading edge of the main image is formed only by the blank image, so that the main printing operation for this portion having the leading blank length LBS can be omitted. In general, in the state of the label resulting from the trailing end-cutting operation for the immediately preceding label, i.e. at the start of the leading end-cutting control process, there remains a blank portion corresponding to a distance (head-to-cutter distance) from the printing position of the print head to the cutting position of the cutter. If the main printing operation is omitted over the leading blank length LBS, it becomes unnecessary to make the leading edge of the print image coincident with the printing position at the start of the leading end-cutting control process, whereby part or all of the blank portion of the tape between the print head and the cutter can be regarded as part or all of the blank image. In other words, omitting the main printing operation over the leading blank length LBS, the waste of tape can be saved by the amount of a portion of the tape utilized for part of the present label to be formed this time, compared with the case of the main printing operation LBS being not omitted.

Still more preferably, the step of carrying out the leading end-cutting control process includes, if the blank image is set to the background image of the present label, carrying out the main printing operation over a length of LD−LBS from the leading edge of the main image, and then carrying out the leading end-cutting operation on condition that the relationship of the head-to-cutter distance LD, the extra print length LA, and the leading blank length LBS satisfies a condition of LD−LA>LBS.

Further preferably, if the blank image is set to the background image of the present label, the leading end-cutting process control means controls the print means such that the print means carries out the main printing operation over a length of LD−LBS from the leading edge of the main image, and controls the cutter such that the cutter then carries out the leading end-cutting operation, on condition that the relationship of the head-to-cutter distance LD, the extra print length LA, and the leading blank length LBS satisfies a condition of LD−LA>LBS.

According to these preferred embodiments, if the blank image is set to the background image of the present label, the main printing operation is carried out over the length of LD−LBS (=LP1) from the leading edge of the main image, on condition that the relationship of the head-to-cutter distance LD, the extra print length LA and the leading blank length LBS satisfies the condition of LD−LA>LBS, followed by carrying out the leading end-cutting operation. As described above, at the start of the leading end-cutting control process for the present label, there remains a portion of the tape corresponding to a distance (head-to-cutter distance L) between the printing position of the print head and the cutting position of the cutter. If the main printing operation is carried out over (LT1=0, and) the length of LD−LBS (=LP1) from the leading edge of the main image, there exits downstream of the printing position a portion of the tape having the length of 2LD−LBS, of which a portion of the tape having the length of LD−LBS exists downstream of the cutting position. More specifically, if the leading end-cutting operation is carried out in this state, the portion of the tape having the length of LD−LBS is cut off.

If the ground image was set to the background image of the present label, a portion of the ground image having the trailing extra print length LAE remains at the leading end of the tape at the start of the leading end-cutting control process for the present label. If the portion having the length of LD−LBS extending from the leading edge of the tape is cut off, from the condition of LS−LA>LBS, the condition of LD−LBS>LA (=LAE+α) holds, even if the ground image was set to the background image of the immediately preceding label, no ground image remains after the leading end-cutting operation. Further, in this case, on a portion of the tape having the length of the head-to-cutter distance LD and remaining between the print head and the cutter after the leading end-cutting operation, the blank image extends over the leading blank length LBS from the leading edge (edge close to the cutting position or the leading cut edge), and a portion of the main image having the length of LD−LBS extending from the leading edge of the main image are printed. Therefore, by omitting the main printing operation over the leading blank length LBS, the waste of tape can be saved by the amount of a portion of the tape having the length LBS out of the portion of the tape having the tape-cutter distance LD utilized for part of the present label to be formed this time, compared with the case of the main printing operation LBS being not omitted.

Further preferably, the step of carrying out the leading end-cutting control process includes, if the blank image is set to the background image of the present label, and at the same time the ground image is set to the background image of the immediately preceding label, feeding the tape by a length of LA+LBS−LD, then carrying out the main printing operation over a length of LD−LBS from the leading edge of the main image, and then carrying out the leading end-cutting operation, on condition that the relationship of the head-to-cutter distance LD, the extra print length LA, and the leading blank length LBS satisfies a condition of LD−LA LBS<LD.

More preferably, if the blank image is set to the background image of the present label, and at the same the ground image was set to the background image of the immediately preceding label, the leading end-cutting process control means controls the print means such that the print means feeds the tape by a length of LA+LBS−LD, and then carries out the main printing operation over a length of LD−LBS from the leading edge of the main image, and controls the cutter such that the cutter then carries out the leading end-cutting operation, on condition that the relationship of the head-to-cutter distance LD, the extra print length LA, and the leading blank length LBS satisfies a condition of LD−LA LBS<LD.

According to these preferred embodiments, if the blank image is set to the background image of the present label, and at the same the ground image was set to the background image of the immediately preceding label, after the tape is fed by the length of LA+LBS−LD, the main printing operation is carried out over the length of LD−LBS from the leading edge of the main image, and then the leading end-cutting operation is carried out on condition that the relationship of the head-to-cutter distance LD, the extra print length LA, and the leading blank length LBS satisfies the condition of LD−LA LBS<LD. If the tape is fed by the length of LA+LBS−LD (=LT1), from the state of a portion of the tape having the length of the head-to-cutter distance remaining between the print head and the cutter at the start of the leading end-cutting control process, there comes to exist a portion of the tape having the length of LA+LBS downstream of the printing position, of which a portion having the length of LA+LBS−LD exists downstream of the cutting position. If the main printing operation is carried out over the length of LD−LBS (=LP1) from the leading edge of the main image, a portion having the length of LA+LD comes to exist downstream of the printing position, and a portion thereof having the length of LA exists downstream of the cutting position. If the leading end-cutting operation is carried out in this state, the portion having the length LA is cut off.

As described above, when the ground image was set to the ground image of the immediately preceding label, a portion of the ground image having the trailing extra print length LAE remains at the leading end of the tape at the start of the leading end-cutting operation. However, the portion of the tape having the length of LA(=LAE+α) is cut off, no ground image remains after the leading end-cutting operation. Further, on a portion of the tape having the length of the head-to-cutter distance LD and remaining between the print head and the cutter after the leading end-cutting operation, the blank image extends over the leading blank length LBS from the leading cut edge and a portion of the main image having the length of LD−LBS extending from the leading edge of the main image is printed. Therefore, a portion of the tape having the length LBS out of the portion of the tape having the tape-cutter distance LD can be utilized for part of the present label, whereby the waste of tape can be saved by the amount of the portion of the tape having the length LBS, and at the same time, a label which are neat up to the leading cut edge can be obtained.

Still more preferably, the step of carrying out the leading end-cutting control process includes, if the blank image is set to the background image of the present label, and at the same the ground image was set to the background image of the immediately preceding label, feeding the tape by the extra print length LAS, and then carrying out the leading end-cutting operation, on condition that the relationship of the head-to-cutter distance LD and the leading blank length LBS satisfies a condition of LD LBS.

Further preferably, if the blank image is set to the background image of the present label, and at the same the ground image was set to the background image of the immediately preceding label, the leading end-cutting process control means controls the print means such that the print means feeds the tape by the leading extra print length LAS, and controls the cutter such that the cutter then carries out the leading end-cutting operation, on condition that the relationship of the head-to-cutter distance LD and the leading blank length LBS satisfies a condition of LD LBS.

According to these preferred embodiments, if the blank image is set to the background image of the present label and at the same the ground image was set to the background image of the immediately preceding label, on condition that the relationship of the head-to-cutter distance LD and the leading blank length LBS satisfies the condition of LD LBS, the tape is fed by the leading extra print length LAS (=LT1, and LP1=0), and then the leading end-cutting operation is carried out. Similarly to the above, when the tape is fed by the length LA (=LT1) in the state where there remains a portion having the length of the head-to-cutter distance LD between the print head and the cutter, a portion having the length of LA+LD comes to exist downstream of the printing position, and a portion thereof having the length LA exists downstream of the cutting position. If the leading end-cutting operation is carried out in this state, the portion having the length LA is cut off.

When the ground image was set to the background image of the immediately preceding label, a portion of the ground image having the trailing extra print length LAE remains at the leading end of the tape at the start of the leading end-cutting control process. However, the portion of the tape having the length of LA (=LAE+$\alpha$) is cut off, no ground image remains after the leading end-cutting operation. Further, a portion of the tape having the length of the head-to-cutter distance LD and remaining between the print head and the cutter after the leading end-cutting operation all becomes part of the blank image having the leading blank length LBS, since LD LBS holds. Therefore, a portion of the tape having the length of the tape-cutter distance LD can be all utilized for part of the blank image having the leading blank length LBS, whereby the waste of tape can be saved, and at the same time, a label which is printed neat up to the leading cut edge can be obtained.

Still more preferably, the step of carrying out the leading end-cutting control process includes, if the blank image is set to the background image of the present label, and at the same time the blank image was set to the background image of the immediately preceding label, carrying out the main printing operation over a length of LD−LBS from the leading edge of the main image, and then carrying out the leading end-cutting operation, on condition that the relationship of the head-to-cutter distance LD and the leading blank length LBS satisfies a condition of LD>LBS.

More preferably, if the blank image is set to the background image of the present label, and at the same time the blank image was set to the background image of the immediately preceding label, the leading end-cutting process control means controls the print means such that the print means carries out the main printing operation over a length of LD−LBS from the leading edge of the main image, and controls the cutter such that the cutter then carries out the leading end-cutting operation, on condition that the relationship of the head-to-cutter distance LD and the leading blank length LBS satisfies a condition of LD>LBS.

According to these preferred embodiments, if the blank image is set to the background image of the present label, and at the same time the blank image was set to the background image of the immediately preceding label, according to the leading end-cutting control process, the main printing operation is carried out over the length of LD−LBS (=LP1) from the leading edge of the main image, and then the leading end-cutting operation is carried out, on condition that the relationship of the head-to-cutter distance LD and the leading blank length LBS satisfies the condition of LD>LBS. Similarly to the above, when the main printing operation is carried out over the length LD−LBS (=LP1) in the state where there remains a portion having the length of the head-to-cutter distance LD between the print head and the cutter, a portion having the length of 2LD−LBS comes to exist downstream of the printing position, and a portion thereof having the length LD−LBS exists downstream of the cutting position. If the leading end-cutting operation is carried out in this state, the portion having the length LD−LBS is cut off.

In this case, if the ground image was not set to the background image of the immediately preceding label, no ground image remains after the leading end-cutting operation. Further, on the portion of the tape having the length of the head-to-cutter distance LD and remaining between the print head and the cutter after the leading end-cutting operation, the blank image extends over the leading blank length LBS from the leading cut edge, and a portion of the main image having the length of LD−LBS extending from the leading edge of the main image is printed. Therefore, a portion of the tape having the length LBS out of the portion of the tape having the tape-cutter distance LD can be utilized for part of the present label, whereby the waste of tape can be saved by the amount of the portion of the tape having the length LBS, and at the same time, a label which is printed neat up to the leading cut edge can be obtained.

Still more preferably, the method includes the step of omitting the leading end-cutting control process, on condition that the relationship of the head-to-cutter distance LD and the leading blank length LBS satisfies a condition of LD LBS, if the blank image is set to the background image of the present label and at the same time the blank image is set to the background image of the immediately preceding label.

More preferably, if the blank image is set to the background image of the present label and at the same time the blank image was set to the background image of the immediately preceding label, the leading end-cutting process control means includes means for omitting the leading end-cutting control process, on condition that the relationship of the head-to-cutter distance LD and the leading blank length LBS satisfies a condition of LD LBS.

According to these preferred embodiments, if the blank image is set to the background image of the present label and at the same time the blank image was set to the background image of the immediately preceding label, on condition that the relationship of the head-to-cutter distance LD and the leading blank length LBS satisfies a condition of LD LBS, the leading end-cutting control process is omitted. Similarly to the above, at the start of the leading end-cutting control process for the present label, there remains a portion having the length of the head-to-cutter distance LD between the print head and the cutter. However, the blank image was set to the background image of the immediately preceding label, and at the same time the condition of LD LBS holds, this portion having the length of the tape-cutter distance LD can be all utilized for part of the present label, and the leading end-cutting operation is not required. Therefore, by omitting the leading end-cutting control process, the tape having the length of the head-to-cutter distance LD can be all used for part of the blank image having the leading blank length, whereby the waste of tape can be saved by the amount of the portion of the tape having the length LBS, and at the same time, a label which is printed neat up to the leading cut edge can be obtained.

Preferably, the tape includes an adhesive layer allowing a portion of the tape cut off by the leading edge cutting operation and the trailing end-cutting operation to be attached to a desired object.

According to this preferred embodiment, a portion of the tape cut off by the leading edge cutting operation and the trailing end-cutting operation can be attached to a desired object. That is, by cutting off the printed portion of the tape on which the print image is printed, a label can be formed which can be attached to a desired object.

Preferably, the print image is printed by an ink jet printing method.

According to this preferred embodiment, the print image is printed by the ink jet printing method. That is, the invention can be applied to a tape printing apparatus which prints print images by the ink jet printing method.

Preferably, the print image is printed by decomposing the print image into a plurality of basic colors, the plurality of basic colors including three primary colors.

According to this preferred embodiment, the print image is printed by decomposing the print image into a plurality of basic colors, and the plurality of basic colors include three primary colors. As the three primary colors for printing, it is possible to employ combinations of e.g. C (cyan), M (magenta), and Y (yellow). In this case, by a so-called subtractive color mixing process, various tones of colors can be expressed, and hence print images can be printed in various tones. Therefore, it is possible to color print images suitable for expressing colors by reflected light, such as those formed by various XY plotters, printers, and the like.

More preferably, the plurality of basic colors further include a basic color corresponding to a mixed color of the three primary colors.

According to this preferred embodiment, the plurality of basic colors further include a basic color corresponding to a mixed color of the three primary colors. When color images are printed by using the plurality of basic colors, e.g. a mixed color of C (cyan), M (magenta), and Y (yellow), K (black) is formed. In general, provision of ink of K (black) makes it possible to obtain a beautiful tone of black color than the use of the K (black) formed by mixing the primary colors. Therefore, since the plurality of basic colors include the basic color corresponding to the mixed color of the three primary colors, beautiful color images can be printed by using the four basic colors.

The above and other objects, features, and advantages of the invention will become more apparent from the following detailed description taken in conjunction with the accompanying drawings.

BRIEF DESCRIPTION OF THE DRAWINGS

FIG. 12 is a table showing examples of various printing conditions provided in a print control condition-setting process as well as print control conditions set based on the printing conditions;

DETAILED DESCRIPTION

Figure 1:
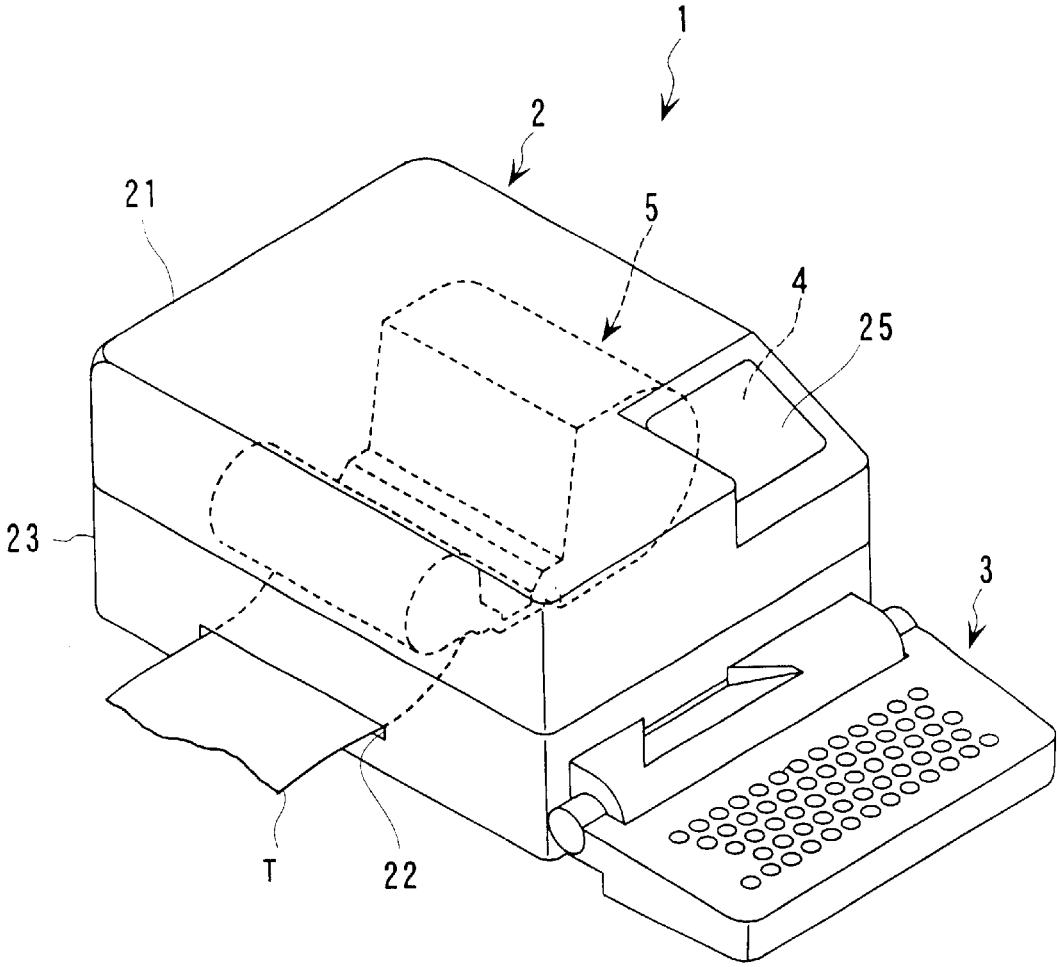
FIG. 1 is a perspective view of a tape printing apparatus according to an embodiment of the present invention.
Figure 2:
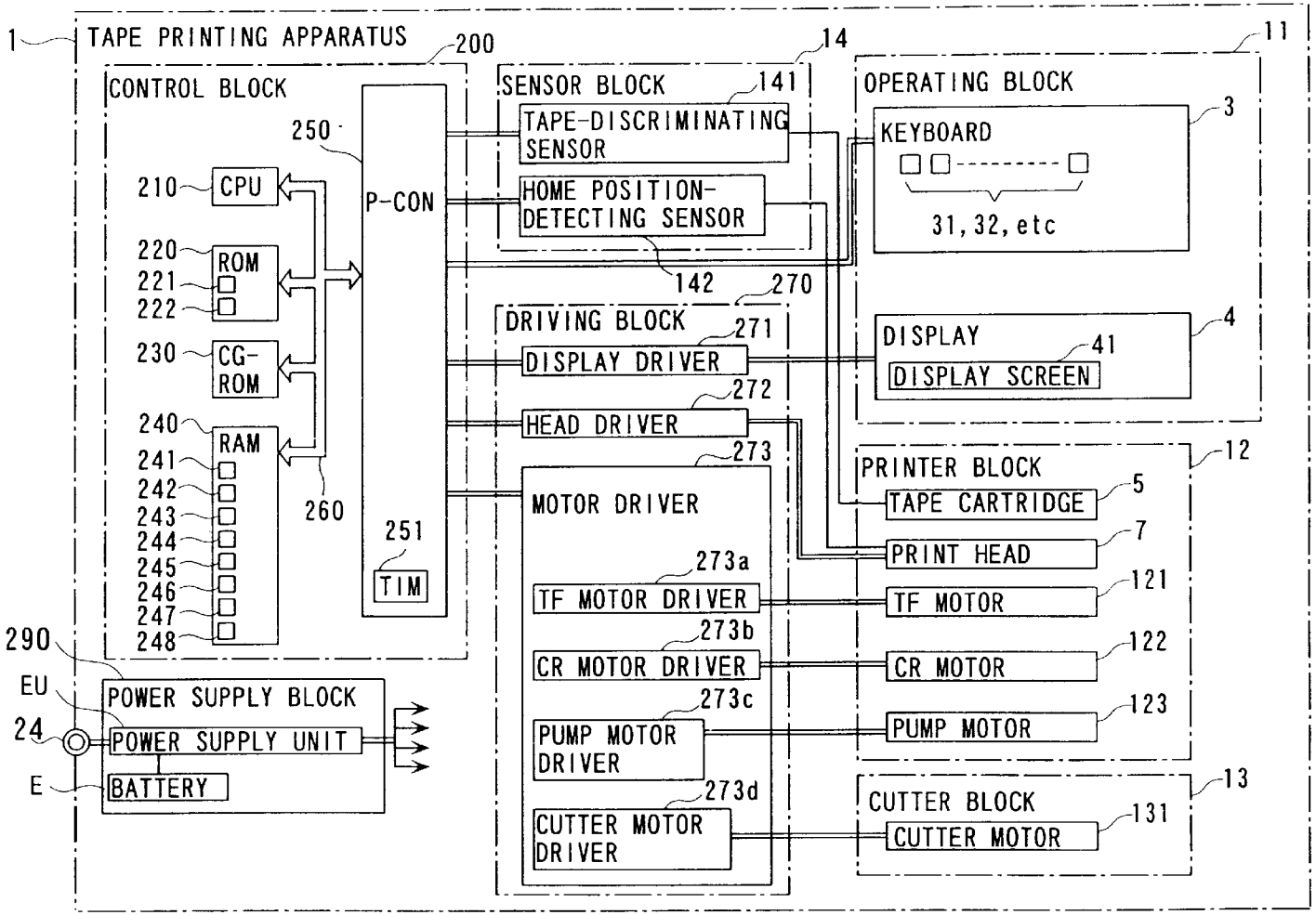
FIG. 2 is a block diagram schematically showing a control system of the FIG. 1 tape printing apparatus.

The invention will now be described in detail with reference to the drawings showing a tape printing apparatus to which are applied a tape printing apparatus and a control method therefor, according to an embodiment thereof. FIG. 1 is a perspective view of the tape printing apparatus, while FIG. 2 is a block diagram of a control system of the FIG. 1 tape printing apparatus.

The tape printing apparatus 1 is capable of carrying out color printing of a print image entered via a keyboard thereof on a printing tape T1 by an ink jet printing method as well as cutting off the printed portion or strip of the printing tape T1 to thereby produce a label. Further, when not only a printing tape T1 but also a laminating tape T2 (see FIGS. 3 and 4) is mounted in this tape printing apparatus 1, the apparatus 1 is also capable of laminating the laminating tape T2 to the printed portion of the printing tape T1 and cutting off the printing tape T1 laminated with the laminating tape T2 to thereby form a laminated label. Hereinafter, a type formed of the printing tape T1 alone and a type formed of both the printing tape T1 and the laminating tape T2 will be generically referred to as "the tape T".

The printing tape T1 is comprised of a substrate tape, an adhesive layer coated on an underside surface of the substrate tape, and a peel-off paper tape affixed to the adhesive layer. The substrate tape is formed of a material which is capable of readily absorbing ink, such as paper, paper with a coated layer, or a film with a coated layer. The adhesive layer is used for affixing the printing tape T1 as a label to an object article, such as a file and the like, while the peel-off paper tape is used for preventing dust or dirt from depositing on the adhesive layer.

On the other hand, the laminating tape T2 is comprised of a substrate tape and an adhesive layer coated on an underside surface of the substrate tape. The substrate tape is formed of a transparent film having a thickness of approximately 16 to 38 $\mu$m. The printing tape T1 and the laminating tape T2 are fabricated to have an approximately identical width and affixed to each other in a manner such that lateral sides thereof are aligned one upon the other. Actually, the laminating tape T2 has a slightly smaller width (by approximately 0.3 mm) than the printing tape T1 such that slight lateral displacement of the laminating tape T2 can be accommodated when the same is affixed to the printing tape T1.

There are provided several kinds (approximately 10 kinds) of tape T having various tape widths (approximately 4.5 to 96 mm), each of which is supplied in a state received in a tape cartridge 5 therefor. A print image having a resolution of 24 to 1024 dots in the direction of the width thereof is printed on the printing tape T, dependent on the width thereof. It should be noted that there are provided still other tapes T which are different in material or have background colors other than white and that it is possible to use at least several tens of kinds of tape T including ones to be adopted in the future. The tape cartridges 5 are classified into a type which can load both a printing tape T1 and a laminating tape T2 therein (see FIG. 4) and a type which can load only a printing tape T1 therein. Each of the two types includes three kinds of tape cartridges i.e. "Large", "Medium" and "Small" cartridges, which are different in height, i.e. width of tapes contained.

Referring first to FIG. 1, the tape printing apparatus 1 is comprised of a body 2, a keyboard 3 mounted on a front-side portion of the body 2, a tape cartridge 5 accommodating the tape T (the printing tape T1 and the laminating tape T2) and an ink cartridge 8 (see FIG. 3) filled with inks of four colors. The tape cartridge 5 and the ink cartridge 8 are removably loaded in the body 2. The body 2 includes an apparatus casing 23. The upper part of the apparatus casing 23 is in the form of a lid 21 which can be opened and closed for loading and removing the tape cartridge 5 and the ink cartridge 8. The apparatus casing 23 has aside wall formed with a tape exit 22 in the form of a slit via which the tape T is delivered out of the apparatus 1.

The keyboard 3 is hinged on a lower portion of a front surface of the body 2 of the tape printing apparatus 1 such that it can be brought either to an upright position or to a horizontal position for use with the body 2. The keyboard 3 is brought to the horizontal position when the apparatus 1 is in use, while it is held in the upright or folded position to cover the front surface of the apparatus 1 when the apparatus 1 is carried by a user. The lid 21 has a small window 25 formed in a right-side front portion thereof in a manner corresponding to a display 4 arranged within the body 2. The keyboard 3 and the display 4 will be described in detail hereinafter.

Further, as shown in FIG. 2, the tape printing apparatus 1 is comprised of an operating block 11 basically including the keyboard 3 and the display 4 for interfacing between the user and the apparatus 1, a printer block 12 including an ink jet print head 7 for printing on the tape T (printing tape T1) unwound from the tape cartridge 5, a cutter block 13 for cutting off the tape T after printing, a sensor block 14 including various sensors for carrying out various kinds of detection, a driving block 270 including various drivers for driving circuits of respective blocks, a power supply block 290, and a control block 200 for controlling the respective blocks within the tape printing apparatus 1.

Therefore, the apparatus casing 23 accommodates not only the printer block 12, the cutter block 13, and the sensor block 14, but also a circuit board, not shown, on which are mounted a circuit of the power supply block 290 as well as circuits of the driving block 270 and the control block 200. The power supply block 290 has a power supply unit EU connected to an AC adapter port 24, or a battery E, such as a nicad battery, which can be mounted and removed from outside. The power supply unit EU supplies power to the electric components of the tape printing apparatus 1.

Figure 3:
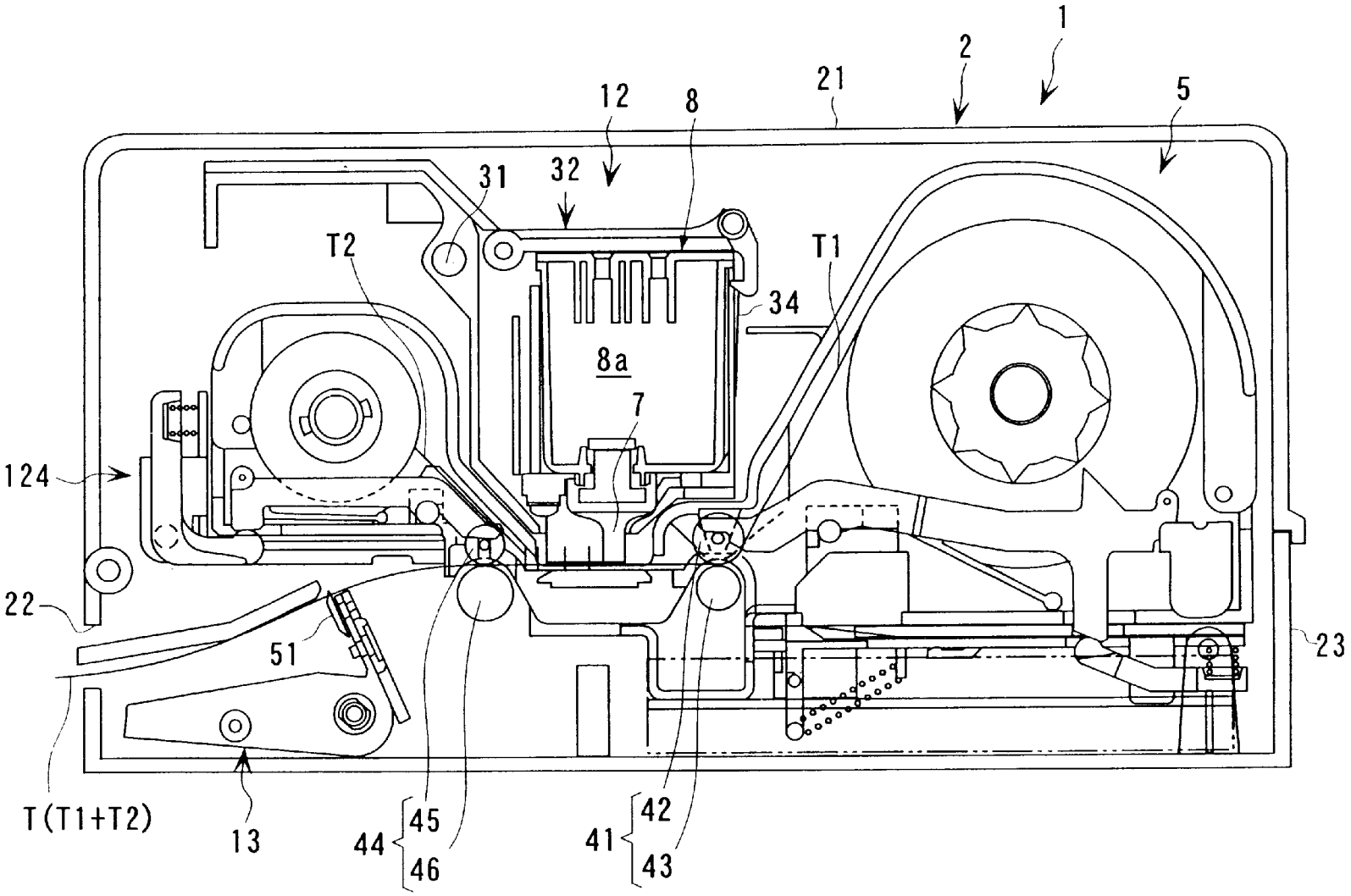
FIG. 3 is a cross-sectional view of a body of the FIG. 1 tape printing apparatus.

FIG. 3 shows the body 2 of the tape printing apparatus 1 in cross section. As shown in FIGS. 2 and 3, the printer block 12 includes a carriage guide shaft 31 having opposite ends thereof supported by a frame, not shown, a carriage 32 slidably mounted on the carriage guide shaft 31, a timing belt, not shown, traveling in normal and reverse directions for reciprocating the carriage 32 transversely to the direction of feed of the tape T (in the direction of the width of the tape T), a carriage motor (CR motor) 122 for causing the timing belt to travel in the normal and reverse directions, feed roller means 41 comprised of a feed driven roller 42 positioned above and a feed drive roller 43 positioned below, laminating roller means 44 comprised of a laminating driven roller 45 positioned above and a laminating drive roller 46 positioned below, a tape feed motor (TF motor) 121 for driving the feed drive roller 43 and the laminating drive roller 46 for rotation via a reduction gear train, not shown, a head cap mechanism, not shown, for closing ink nozzles of the print head 7 and cleaning the same by using a pump motor 123 as required, and an ejection mechanism 124 for setting and ejecting the tape cartridge 5.

The print head 7 for printing on the tape T and a cartridge holder 34 for holding the ink cartridge 8 that supplies ink are mounted at lower and upper portions of the carriage 32, respectively, in a manner forming a unit. The print head 7 faces downward, and the ink cartridge 8 is mounted within the cartridge holder 34 such that it has its delivery port directed downward. When the ink cartridge 8 is mounted, ink reservoirs 8*a* thereof, each of which contains ink of a different color, communicates with the print head 7 for supply of ink. The ink reservoirs 8*a* contain C (cyan) ink, M (magenta) ink, Y (yellow) ink, and K (black) ink, respectively.

Further, the carriage 32 has light shields, not shown, projecting therefrom. When one of the light shields is brought before an associated one of position-detecting sensors 142 each comprised of a photo interrupter or the like, the print head 7 is detected to be at a home position, not shown, whereby the correction of the position of the print head 7, such as zero position adjustment, is carried out. The home position serves not only as a stand by position of the print head 7 but also as a reference position for printing. The CR motor 122 is driven for rotation in a predetermined number of steps from the reference position, whereby the carriage 32 is moved with accuracy to each position in the direction of the width of the tape T within a printing range, and the print head 7 is driven in synchronism with movement of the carriage 32 to thereby effect printing on a surface of the tape T in a desired manner.

Figure 4:
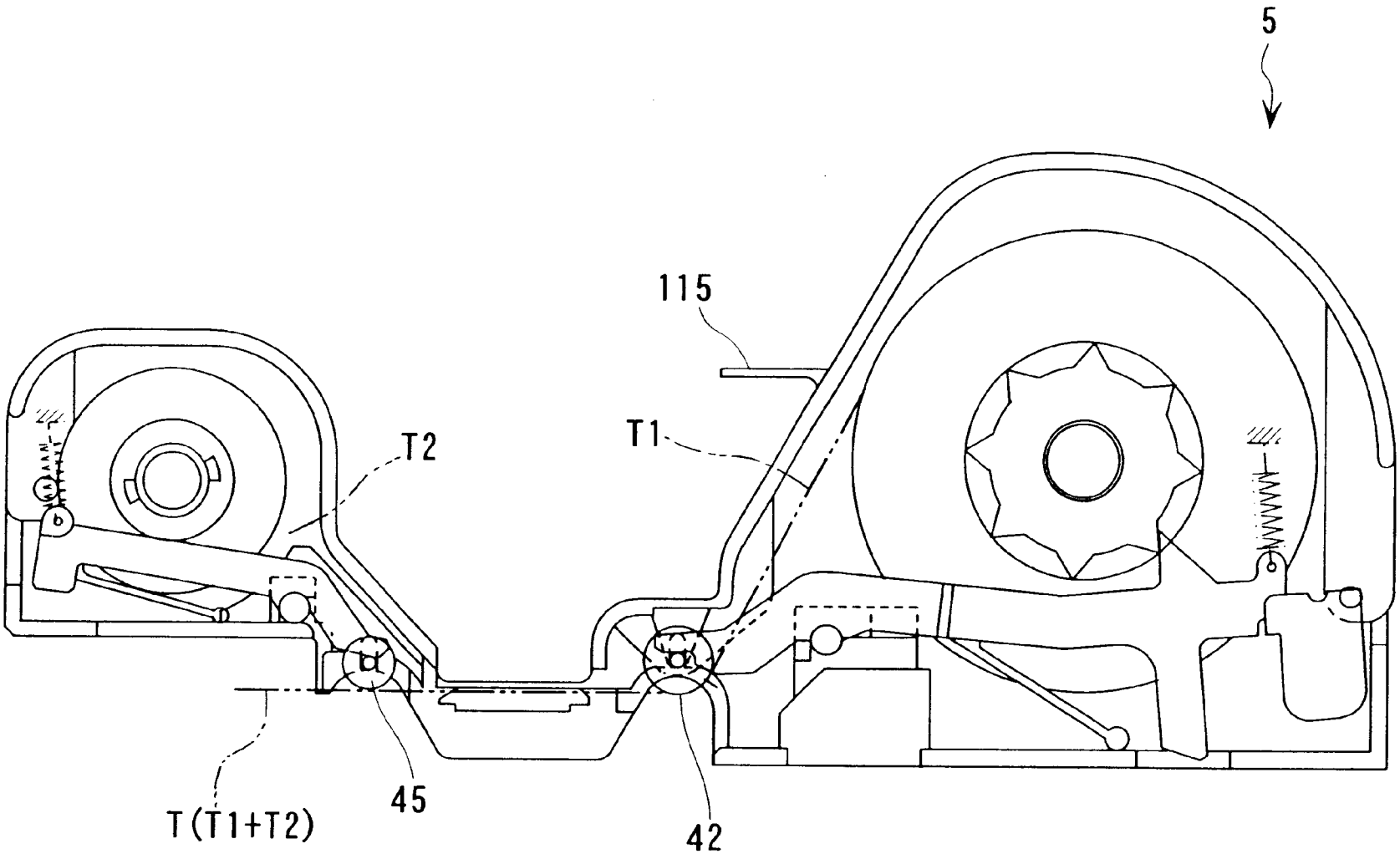
FIG. 4 is a side cross-sectional view of a tape cartridge mounted in the FIG. 1 tape printing apparatus.

The tape cartridge 5 is provided with a discriminating plate 115 bearing discriminating information based on bit patterns or the like (see FIG. 4). A tape-discriminating sensor 141 mounted on the carriage 32 is brought to the discriminating plate 115 to thereby discriminate the type or kind of each of the tape cartridge 5, the printing tape T1 and the laminating tape T2 as well as detect a print-starting position for starting a printing operation on each printing tape T1. Hereinafter, signals indicative of results of the sensing are referred to as "the tape-discriminating signals".

The feed drive roller 43 is arranged in the body 2 of the tape printing apparatus 1, while the feed driven roller 42 is arranged in the tape cartridge 5. When the tape cartridge 5 is mounted in the body 2, the feed driven roller 42 presses the printing tape T1 in a manner sandwiching the tape T1 between the feed drive roller 43 and the feed driven roller 42 itself. The printing tape T1 is advanced in this state as the TF motor 121 rotates.

The laminating drive roller 46 is arranged in the body 2, while the laminating driven roller 45 is arranged in the tape cartridge 5. When the tape cartridge 5 is mounted in the body 2, the laminating driven roller 45 presses the printing tape T1 and the laminating tape T2 in a manner sandwiching the same between the laminating drive roller 46 and the laminating driven roller 45 itself. The printing tape T1 and the laminating tape T2 are advanced in this state while being affixed to each other as the TF motor 121 rotates.

The cutter block 13 includes a cutter 51 and a cutter motor 131 for driving the cutter 51 for cutting operation. After printing is completed, the tape T (the printing tape T1+the laminating tape T2) is stopped when the TF motor 121 feeds the same further by a predetermined number of steps, and at the same time, the cutter motor 131 starts driving the cutter 51 for cutting the tape T. It should be noted that in the tape printing apparatus 1, a cutting key, not shown, is provided so that the cutting operation can be manually carried out by key stroke, and it is possible to selectively set one of an automatic cutting mode and a manual cutting mode.

As shown in FIG. 2, the sensor block 14 is comprised of the tape-discriminating sensor 141 and the home position-detecting sensor 142. As described above, the tape-discriminating sensor 141 not only discriminates the type or kind of each of the tape cartridge 5, the printing tape T1, etc. but also detects the print-starting position for starting a printing operation on each printing tape T1, while the home position-detecting sensor 142 detects that the print head 7 is at its home position. The two sensors 141 and 142 deliver respective signals (tape-discriminating signal and position-detecting signal) to the control block 200. It should be noted that it is possible to provide other sensors as well, such as a voltage sensor to be connected to the power supply unit EU of the power supply block 290 supplying power to each of the electric components in the tape printing apparatus 1, for detecting changes in electric potential, an ambient temperature sensor, a head surface temperature sensor, and the like, according to actual conditions of the apparatus 1. Conversely, it is also possible to dispense with some of the sensors.

The driving block 270 includes a display driver 271, ahead driver 272, and a motor driver 273. The display driver 271 drives the display 4 of the operating block 11 in response to control signals delivered from the control block 200, i.e. in accordance with commands carried by the signals. Similarly, the head driver 272 drives the print head 7 of the printer block 12 in accordance with commands from the control block 200. Further, the motor driver 273 has a TF motor driver 273*a* for driving the TF motor 121 of the printer block 12, a CR motor driver 273*b* for driving the CR motor 122, a pump motor driver 273*c* for driving the pump motor 123, and a cutter motor driver 273*d* for driving the cutter motor 131 of the cutter block 13, and similarly to the display driver 271 and the head driver 272, drives each motor in accordance with commands from the control block 200.

The operating block 11 includes the keyboard 3 and the display 4. The display 4 has a display screen 40 which is capable of displaying display image data of 96×64 dots on a rectangular display area of approximately 6 cm in the horizontal direction (X direction)×4 cm in the vertical direction (Y direction). The display 4 is used by the user to enter data via the keyboard 3 to form or edit matrix data indicative of print image data, such as character string image data, view the resulting data, and enter various commands including ones for selecting menu options via the keyboard 3.

On the keyboard 3, there are arranged a character key group 31 including an alphabet key group, not shown, a symbol key group, not shown, a number key group, not shown, and a nonstandard character key group, not shown, for calling nonstandard characters for selection, as well as a function key group 32 for designating various operation modes. In a type of the apparatus 1 which is capable of entering the Japanese language, there is also provided a kana key group, not shown, for entering Japanese hiragana letters and Japanese katakana letters.

The function key group 32 includes a power key, not shown, a print key, not shown, for instructing a printing operation, a form key, not shown, for displaying selection screens for switching between various operating modes, such as character size-related modes, decorations-related modes, etc. as well as between various forms, a selection key, not shown, for finally determining entry of character data and starting new lines during text entry as well as determining selection of one of the various operating modes on a corresponding one of the selection screens, a color specification key, not shown, for specifying printing colors including neutral colors (mixed colors) of print image data, a color-setting key, not shown, for setting colors of characters and background colors, and four cursor keys (up arrow key, down arrow key, left arrow key, and right arrow key), not shown, for moving the cursor or the display range of print image data on the display screen 40 in respective upward, downward, leftward, and rightward directions.

The function key group 32 also includes a cancel key, not shown, for canceling instructions, a shift key, not shown, for use in changing roles of respective keys as well as modifying registered image data, an image key, not shown, for alternately switching between a text entry screen or a selection screen and a display screen (image screen) for displaying print image data, a proportion-changing (zoom) key, not shown, for changing a proportion between the size of print image data and the size of display image data displayed on the image screen, and the cutting key for manually cutting the tape T.

Similarly to keyboards of the general type, the above key entries may be made by separate keys exclusively provided for respective key entries and/or by a smaller number of keys operated in combination with the shift key or the like. Here, for purposes of ease of understanding, the following description will be made assuming that there are provided as many keys as described above.

As shown in FIG. 2, from the keyboard 3, various commands described above and data are input to the control block 200.

The control block 200 includes a CPU 210, a ROM 220, a character generator ROM (hereinafter referred to as "the CG-ROM") 230, a RAM 240, and a peripheral control circuit (hereinafter referred to as "the P-CON") 250, all of which are connected to each other by an internal bus 260.

The ROM 220 includes a control program memory area 221 storing control programs executed by the CPU 210 and a control data memory area 222 storing control data containing a color conversion table, a character modification table, dither matrices, predetermined basic (regular) dither masks, and so forth. In the type of the apparatus 1 which is capable of entering the Japanese language, there is also provided a conversion table for converting Japanese hiragana letters into respective corresponding Japanese katakana letters. The CG-ROM 230 stores font data of characters or the like provided for the tape printing apparatus 1, and outputs corresponding font data when code data identifying a character or the like is given thereto.

The RAM 240 is supplied with backup power such that stored data items can be preserved even when the power is turned of f by operating the power key. The RAM 240 includes areas of a register group 241, a text data area 242 for storing text data of letters or the like entered by the user via the keyboard 3, a displayed image data area 243 for storing image data representative of an image displayed on the display screen 40, a print image data area 244 for storing print image data representative of a print image, a registered image data area 245 for storing registered image data items representative of registered images, a dither mask area 246 for storing a dither mask in use or after use, a color palette data area 247 for storing color palette information concerning printing colors and the like, and various buffer areas 248, such as a character-forming buffer (font color buffer), a color conversion buffer, a basic color-by-basic color arranging buffer, and a print buffer. The RAM 240 is used as work areas for carrying out the control process.

The P-CON 250 incorporates a logic circuit for complementing the functions of the CPU 210 as well as dealing with interface signals for interfacing between the CPU 210 and peripheral circuits. The logic circuit is implemented by a gate array, a custom LSI and the like. For instance, a timer (TIM) 251 is incorporated in the P-CON 250 for the function of measuring elapsed time. Accordingly, the P-CON 250 is connected to the sensors of the sensor block 14 and the keyboard 3, for receiving the above-mentioned signals generated by the sensor block 14 as well as commands and data entered via the keyboard 3, and inputting these to the internal bus 260 directly or after processing them. Further, the P-CON 250 cooperates with the CPU 210 to output data and control signals input to the internal bus 260 by the CPU 210 or the like, to the driving block 270 directly or after processing them.

The CPU 210 of the control block 200 receives the various signals/data items, etc. from the respective blocks within the tape printing apparatus 1 via the P-CON 250, according to the control program read from the ROM 220, processes font data from the CG-ROM 230 and various data stored in the RAM 240, and delivers various signals/data items, etc. to the respective blocks within the apparatus 1 via the P-CON 250, to thereby carry out position control during printing operations, display control of the display screen 40, and print control that causes the print head 7 to carry out printing on the tape T under predetermined printing conditions. In short, the CPU 210 controls the overall operation of the tape printing apparatus 1.

Next, the overall control process carried out by the tape printing apparatus 1 will be described with reference to FIG. 5. As shown in the figure, when a program for carrying out the control process is started, e.g. when the power of the tape printing apparatus 1 is turned on by operating the power key, first, at step S1, initialization of the system including restoration of saved control flags is carried out to restore the tape printing apparatus 1 to the state it was in before the power was turned off the last time. Then, the image that was displayed on the display screen 40 before the power was turned off the last time is shown as an initial screen at step S2.

Figure 5:
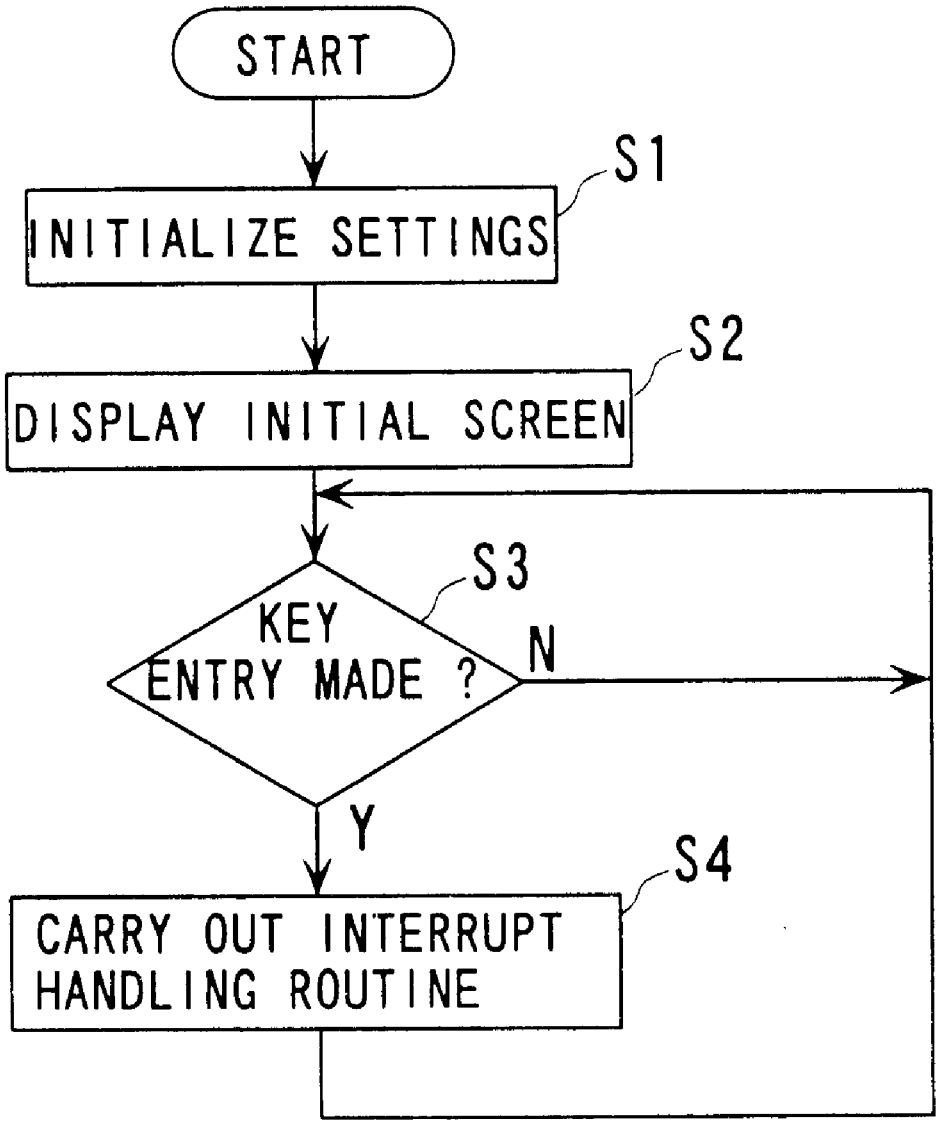
FIG. 5 is a flowchart showing an overall control process executed by the FIG. 1 tape printing apparatus.

The following steps in FIG. 5, that is, step S3 for determining whether or not a key entry has been made and step S4 for carrying out an interrupt handling operation are conceptual representations of actual operations.

Actually, when the initial screen has been displayed at step S2, the tape printing apparatus 1 enables an interrupt by key entry (keyboard interrupt), and maintains the key entry wait state (No to S3) until a keyboard interrupt is generated.

When the keyboard interrupt is generated (Yes to S3), a corresponding interrupt handling routine is executed at step S4, and after the interrupt handling routine is terminated, the key entry wait state is again enabled and maintained (No to S3).

As described above, in the tape printing apparatus 1, main processing operations by the apparatus are carried out by interrupt handling routines, and hence if print image data for printing is provided or has been prepared, the user can print the image data at a desired time, by depressing the print key to thereby generate an interrupt by the print key and start a printing process.

Figure 6:
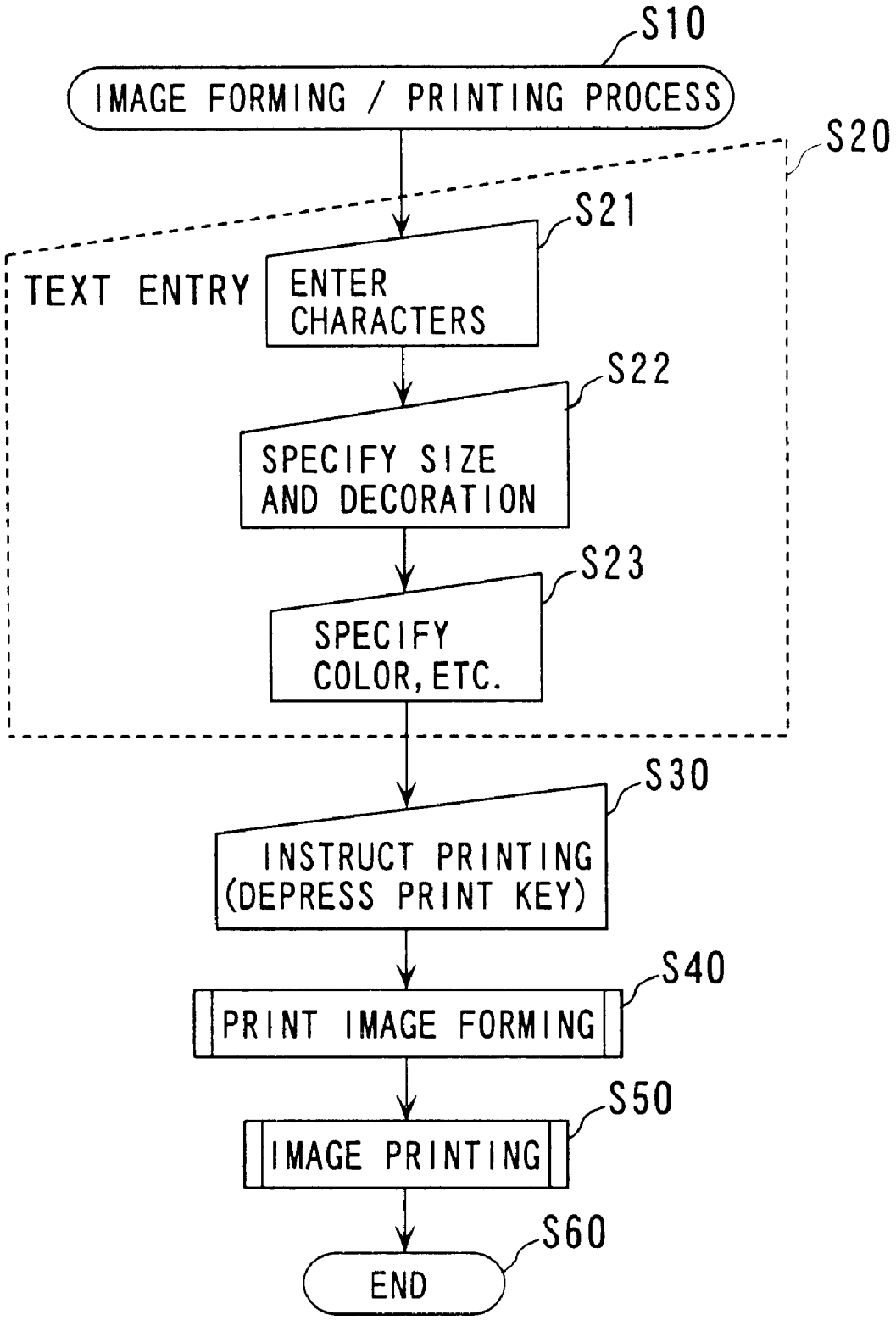
FIG. 6 is a flowchart showing a typical example of an image-forming/printing process.

FIG. 6 shows a flowchart of a routine for a typical image-forming/printing process executed by the tape printing apparatus 1. First, in this process (S10), as shown in the figure, text data of letters or the like is entered into the text data area 242 at step S20. More specifically, the user enters a character string of desired characters (represented by "letters" in the following description) and specifies its color by the keyboard 3 while confirming or viewing the results of the entry on the display 4. For example, letter strings "ABCDEF" and "GHIJKL" are entered on a first line and a second line, respectively, at step S21 (see FIG. 7A), and then, a size and a decoration of the letters are specified at step S23, followed by color specification, etc. being carried out at step S23.

To specify a size or a decoration, the form key is depressed to display a selection screen, and the cursor keys are operated in this state to select a desired one of options displayed on the screen. Then the selection key is depressed to finally determine the desired size or decoration. On the other hand, to specify a color, gradation values or gray levels of C (cyan), M (magenta), and Y (yellow) are designated on the display screen 40 by depressing the color specification key, based on color information defined by a preset color conversion table, and colors of letters and their background are specified and set by depressing the color-setting key. In the present embodiment, K (black) is selected as a printing color of letters forming a main image (i.e. a letter color), and Y (yellow) as a printing color of the background (i.e. a background color).

This background color is printed on the tape T so as to make the tape appear to have a ground color of its own. Further, the tape printing apparatus 1 is capable of forming a background pattern of the tape T by combination of one or more of registered images. In this case, at the step of color specification, etc. (S23), a unit image is formed or constructed on the display 4 and determined by depressing the selection key, and then a background therefor is specified and set by depressing the color-setting key similarly to color specification (that is, the pattern is also regarded as a combination of colors). Needless to say, it is possible to set a desired color for this unit image. Thus, the background pattern of the tape T can be formed by laying out the unit images in a sequential and regular manner. The ground color or background pattern of the tape T is generically referred to as "the ground image" hereinafter. In the figures and description of the present embodiment, for simplicity, solid Y (yellow) is set as the ground image, as described above, whereby the tape T is only made to appear to have the ground color (own color). If the ground image is not set as a background image, a blank image which is a non-printed area is set.

As shown in FIG. 6, when the text entry of the letter string "ABCDEF" or the like is completed at step S20, and a printing operation is instructed at step S30, print image data representative of the print image is formed at step S40. A general type of image can be represented by image data e.g. of a binary matrix (dot matrix) composed of two-valued (binary) matrix elements, with "1" assigned to matrix elements corresponding to respective valid pixels which are to be printed and "0" assigned to matrix elements corresponding to respective invalid pixels which are not to be printed, and in the apparatus 1, actual image processing is performed on the image data. More specifically, a print image is realized only when it is printed based on corresponding print image data. In the following description, however, e.g. an expression "a print image is formed" is used for brevity in place of "print image data representative of a print image is formed". Thus, the print image is formed at step S40.

It should be noted that a ground image is for making the tape T appear to have its own ground color or background pattern, so that even when leading and trailing margins are set for a print image in the case of so-called fixed length printing, the ground image is also printed on the margins. Therefore, the print image of this embodiment is formed to include leading and trailing margins of this kind. When the print image is completely formed at step S50, printing of the print image on the tape T and cutting of leading and trailing edges of the print image are carried out to produce a desired label (S50), followed by terminating the image-forming/printing process (S10) at step S60.

Figure 7A:
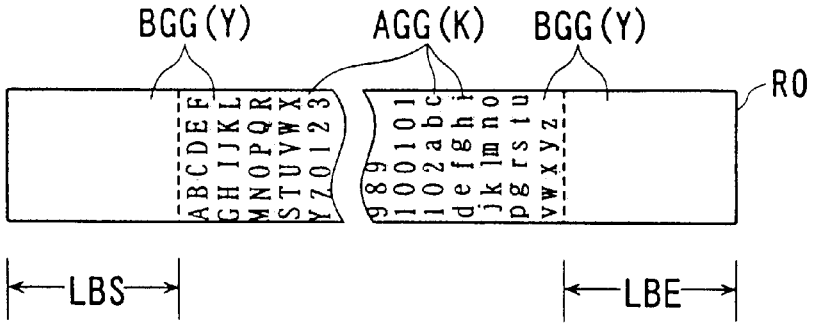
FIG. 7A is a diagram useful for explaining a main image, a background image, and a print image including the main image and the background image as well as a label printed with the print image.

Through the above process (S10), e.g. a label R0 shown in FIG. 7A can be produced. More specifically, it is possible to produce a label R0 printed with a main image AGG(K) which is formed by an image of character strings "ABCDEF" to "vwxyz" and whose color is specified as K(black) as well as with a background image BGG(Y) for the main image AGG(K), which appears to be the ground image (ground color) of an area of the tape T having a print image length LR which is a length of the print image (equal to a length of the label in this case) and whose color is specified as Y(yellow). It should be noted that the alphabets in the parentheses after the main image AGG and the background image BGG represent respective specified colors.

As described above, in the tape printing apparatus 1, a print image formed e.g. by the main image AGG(K) and the background image BGG(Y) is printed by main printing on the tape T which is a print material, and then a leading end-cutting process for cutting the tape T at a leading edge of the print image and a trailing end-cutting process for cutting the tape T at a trailing edge of the print image are executed, whereby the label R0 printed with the print image is produced. Further, in the tape printing apparatus 1, it is possible to select and designate one of a plurality of background image settings including a blank image setting for setting a blank image (which is not actually printed) as the background image (the following diagrammatic representation and description are made, assuming that the original color of the tape T is white and that a background image specified when a blank image is selected as the background image is represented by a background image BGG(W)), and a ground image setting for setting a ground image for making the tape T appear to have as at least one of a ground color and a background pattern of its own, so that it is only required to provide one kind of tape T (e.g. a white one).

Figure 7B:
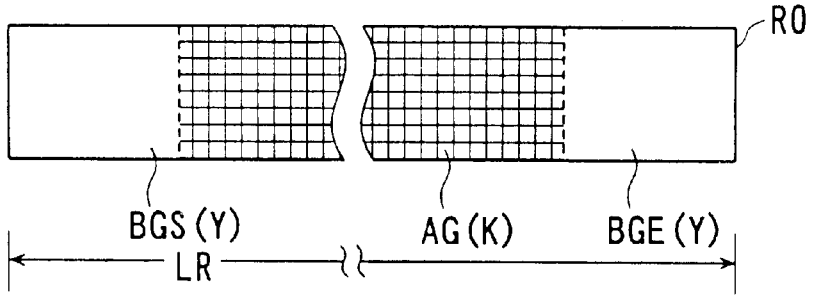
FIG. 7B is a simplified diagram of FIG. 7A.

For simplicity of the following diagrammatic representation and description, the printed portion of the tape T shown in FIG. 7A is simplified e.g. as in FIG. 7B. More specifically, an area (meshed portion in FIG. 7B) from a leading edge of the main image AGG(K) to a trailing edge of the same is referred to as a main portion AG(K), a length between the leading edge of the print image (i.e. a leading edge which the label has after execution of a leading end-cutting operation) and the leading edge of the main image AGG(K) (i.e. a leading edge of the main portion AG(K)) is referred to as a leading background length (leading blank length in the case of a blank image being set to the background image; a leading margin length and the like are included in the leading background length) LBS, and an area (leading dot shaded portion shown in the figure) between the leading edge of the print image and the leading edge of the main image AGG(K), which is printed with the background image BGG(Y) alone, is referred to as a leading background portion BGS(Y), while a length between the trailing edge of the main image AGG(K) (i.e. a trailing edge of the main portion AG(K)) and the trailing edge of the print image (i.e. a trailing edge which the label has after execution of a trailing end-cutting operation) is referred to as a trailing background length (a trailing blank length in the case of a blank image being set to the background image, a trailing margin length and the like are included in the trailing background length) LBE, and an area (trailing dot shaded portion shown in the figure) between the trailing edge of the main image AGG(K) and the trailing edge of the print image, which is printed with the background image BGG(Y) alone, is referred to as a trailing background portion BGE (Y).

In the tape printing apparatus 1, as will be described in detail hereinafter, print control conditions for printing a print image is set based on predetermined printing conditions including a condition of whether a ground image is set to the background image, whereby based on print image data representative of the print image and the print control conditions, the printer block (printing means) 12 is controlled for various printing operations including the main printing, and the cutter block (cutting means) 13 is controlled for the leading end-cutting and trailing end-cutting operations. Now, description will be made of an outline of image printing (S50 in FIG. 6) performed when a ground image is set to the background image of a print image in the present label-forming process (this expression "present label-forming process" is used to distinguish itself from "immediately preceding label-forming process", referred to hereinbelow).

Figures 8A, 8B, 8C, 8D, 8E:
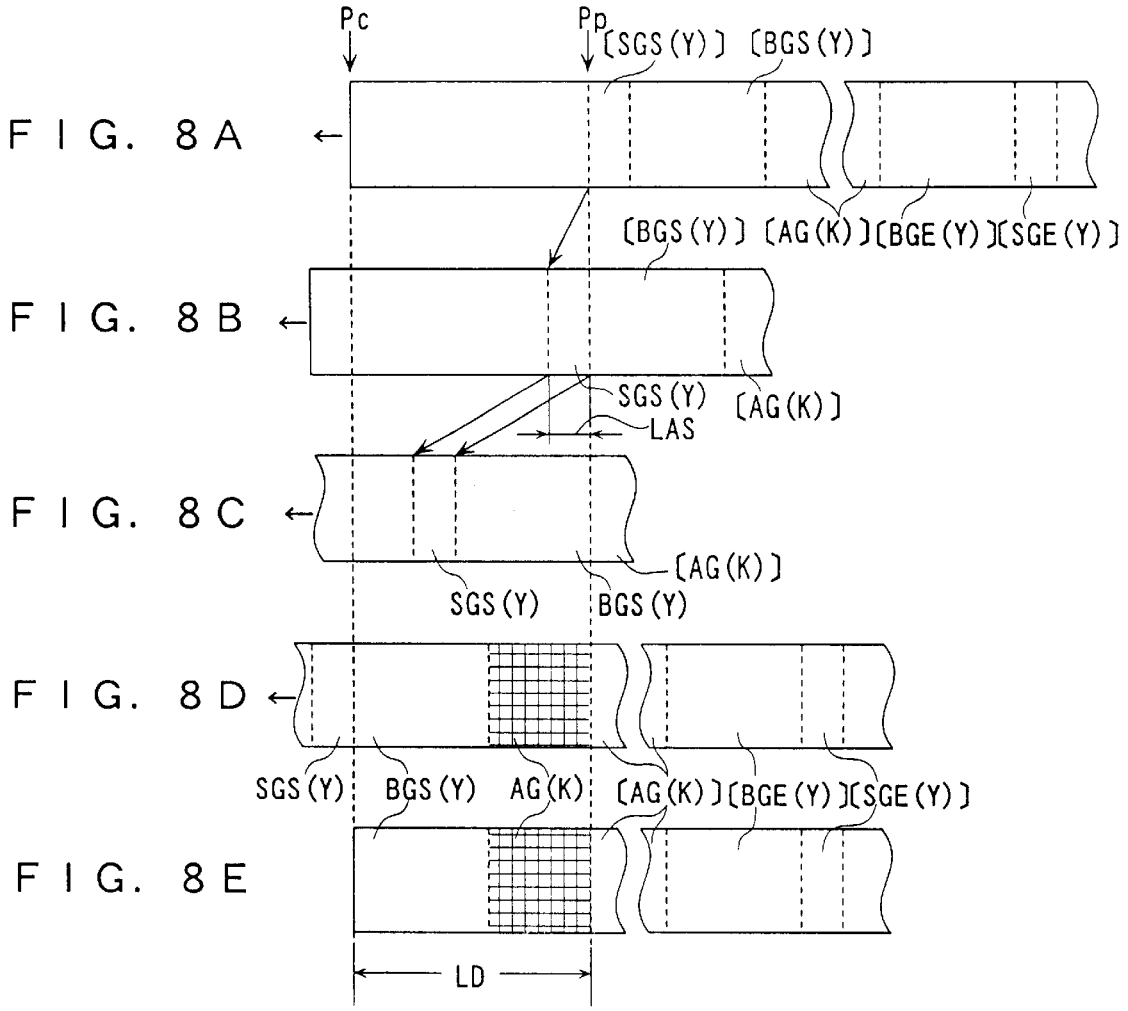
FIGS. 8A to 8E are diagrams illustrating an image-printing process in FIG. 6, which is executed in the case of a ground image being set as a background image of a print image in the present label-forming process.

Referring to FIGS. 8A to 8E, normally at the start of the present label-forming process, the leading edge of the tape T is at a position where the trailing end-cutting process was carried out in the immediately preceding label-forming process, i.e. at a cutting position Pc at which the cutter 51 cuts the tape and which is away from a printing position Pp at which the print head 7 carries out printing, by a predetermined head-to-cutter distance LD between the print head 7 and the cutter 51 (see FIG. 8A). Each bracketed portion in FIGS. 8A to 8B and the following figures indicates an area of the tape T which, after having passed through the printing position Pp (i.e. after printing), eventually forms a printed portion specified within the bracket. In the tape printing apparatus 1, when a ground image is set to the background image of a print image to be printed in the present label-making process, first, the ground image is printed in a manner continuing to the background image, while feeding the tape T downstream (leftward as viewed in the figures), on an extra portion between a location forward of the leading edge of the print image by a predetermined leading extra print length LAS and the leading edge of the print image (the extra portion, which is dot shaded similarly to a background portion in the figures, is hereinafter referred to as "the leading extra print portion SGS(Y)) (see FIG. 8B). The printing of the ground image on the extra portion will be referred to as "extra printing" (extra printing operation) hereinafter.

Subsequently, the print image is printed sequentially on the leading background portion BGS(Y) having the leading background length LBS, the main portion AG(K), and the trailing background portion BGE(Y) having the trailing background length LBE. This printing is hereinafter referred to as "main printing" (main printing operation) (see FIGS. 8C to 8E and 9A to 9C (FIG. 8E is identical to FIG. 9A)). In the course of the main printing, at a time the leading edge of the print image (i.e. the leading edge of the leading background portion BGS(Y) or the trailing edge of the leading extra print portion SGS(Y)) coincides with the cutting position Pc (see FIG. 8D), the feeding of the tape T is once stopped, and the tape T is cut by the cutter 51. In short, the leading end-cutting operation is performed to cut the tape T at the leading edge of the print image (see FIG. 8E). In this case, since the leading end-cutting operation is carried out after the ground image having been printed over the predetermined leading extra print length LAS, it is possible to obtain a label having the ground image printed there on beautifully up to its leading cut edge even if the cutting position for the leading end-cutting process is not so accurate.

Figures 9A, 9B, 9C, 9D, 9E, 9F:
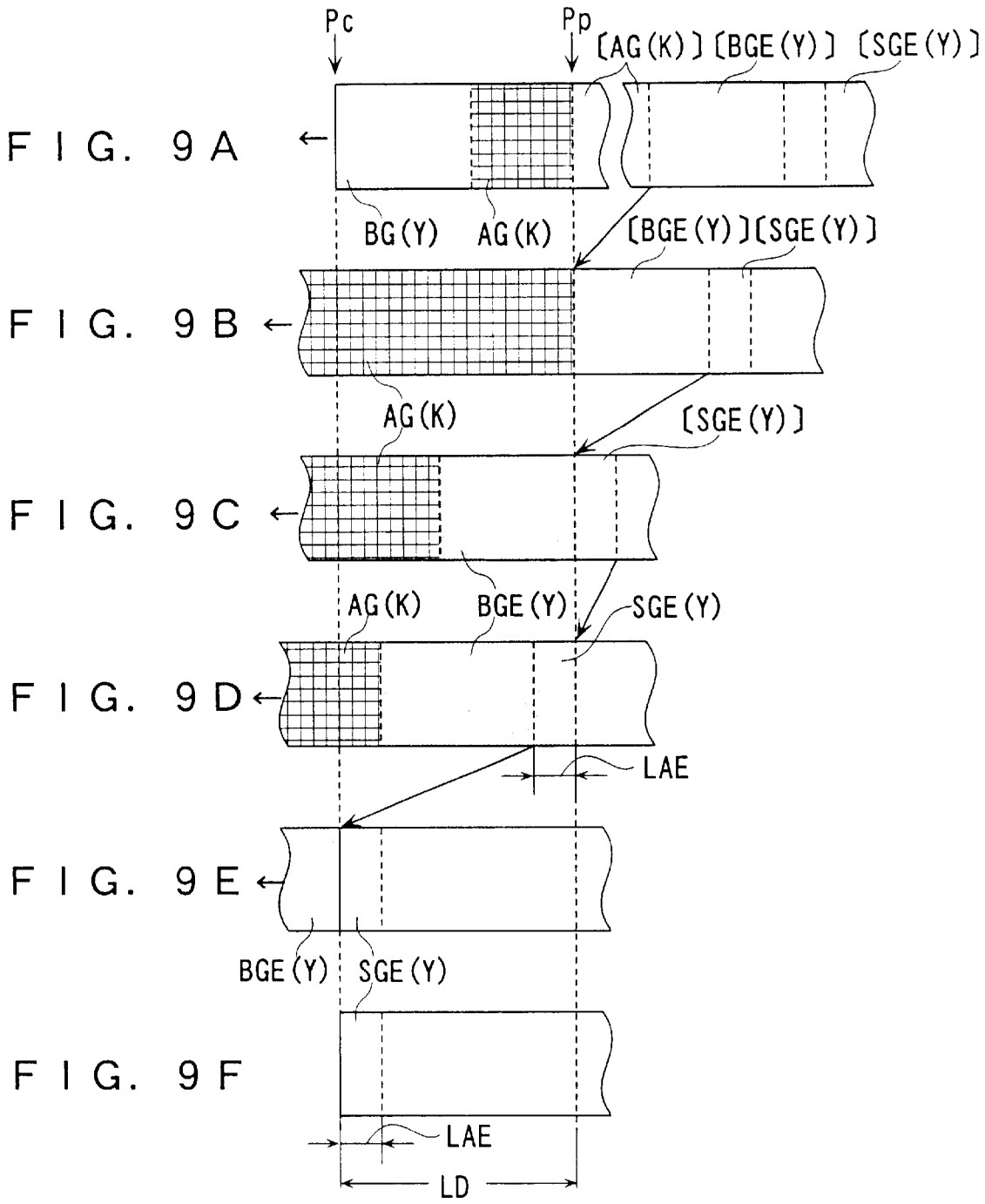
FIGS. 9A to 9F are diagrams similar to FIGS. 8A to 8E and continued therefrom.

After the leading end-cutting operation is completed, the printing of the print image (main printing) is continued while feeding the tape T downstream again (see FIGS. 9A to 9C), until the main printing is completed (see FIG. 9C). After the completion of the main printing, the ground image continuous with the background image is printed by extra printing, while further feeding the tape T downstream, on an extra portion between a trailing edge of the print image and a location a predetermined trailing extra print length LAE rearward of the trailing edge of the print image (the extra portion, which is dot shaded similarly to the background portion in the figures, is hereinafter referred to as "the trailing extra print portion SGE(Y)). Thereafter, the feeding of the tape T is further continued without printing, and at a time the trailing edge of the print image (i.e. the trailing edge of the trailing background portion BGE(Y) or the leading edge of the trailing extra print portion SGE(Y)) coincides with the cutting position Pc (see FIG. 9E), the feeding of the tape T is stopped, and the tape T is cut by the cutter 51. In short, the trailing end-cutting operation is performed to cut the tape T at the trailing edge of the print image (see FIG. 9F). In this case, since the trailing end-cutting operation is carried out after the ground image having been printed over the predetermined trailing extra print length LAE, it is possible to obtain a label having the ground image printed thereon beautifully up to its trailing cut edge even if the cutting position of the trailing end-cutting operation is not so accurate. It should be noted that the leading and trailing extra print lengths LAS and LAE may be uniformly set to be equal to each other (LAS=LAE) or otherwise set individually as desired.

As described above with reference to FIG. 8A, at the start of the present label-forming process, the leading edge of the tape T is normally at the cutting position Pc where the trailing end-cutting operation was carried out in the immediately preceding label-forming process. However, when the ground image was set to the background image in the immediately preceding label-forming process, as is apparent from FIG. 9F, a portion which was the trailing extra print portion SGE(Y) in the immediately preceding label-forming process is left as a leading edge portion of the tape T. In other words, at the start of the present label-forming process, the tape T has the trailing extra print portion in the immediately preceding label-forming process (this portion (hatched portion in FIG. 10A) is hereinafter referred to as "the remaining extra printed portion RSGE") as its leading edge portion as shown in FIG. 10A.

Figures 10A, 10B, 10C:
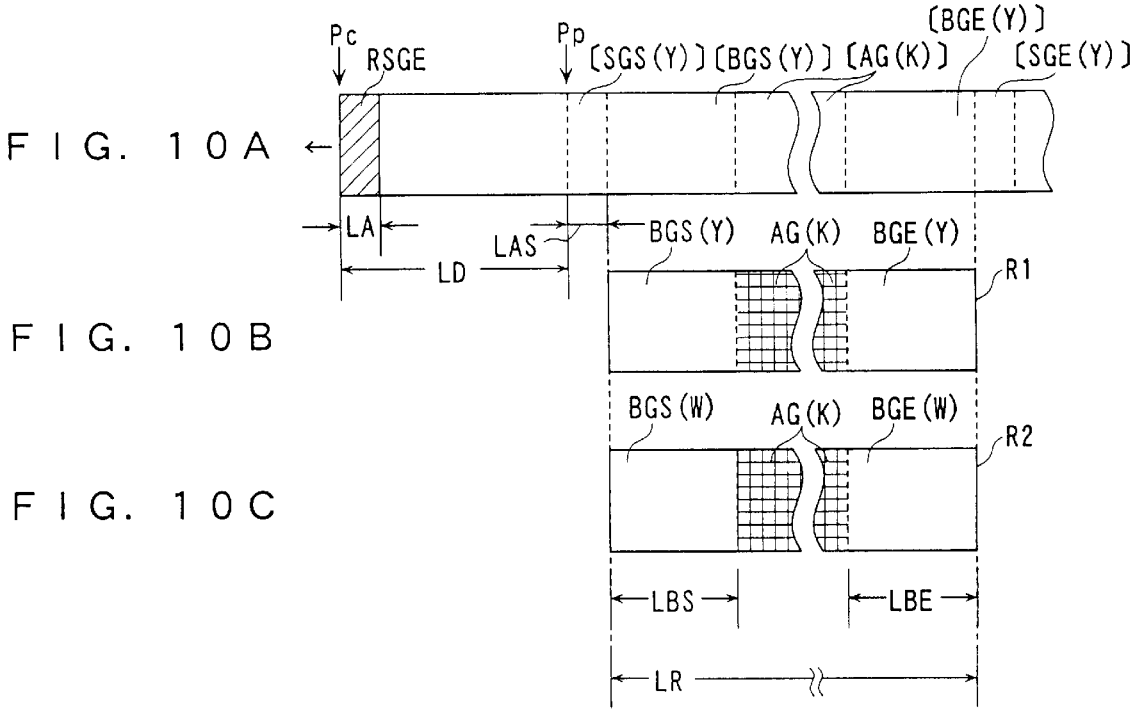
FIG. 10A is a diagram schematically showing a state of a printing tape at the start of the present label-forming process in the case of a ground image having been set as a background image of a print image in the immediately preceding label-forming process.
FIG. 10B is a diagram schematically showing a portion to be eventually cut off as a label.
FIG. 10C is a diagram which is useful in explaining a case of a blank image being set to the background of the print image in the present label-forming process.

When the image printing (S50 in FIG. 6) to be performed in the case of a ground image being set to the background image of a print image is started in the state shown in FIG. 10A and carried out following the procedure described above with reference to FIGS. 8A to 8E and 9A to 9F, a portion of the tape T shown in FIG. 10B is eventually printed into a desired label R1. Even when a blank image is set to the background of the print image, so long as the printing is controlled following the same procedure as shown in FIGS. 8A to 8E and 9A to 9F, a portion of the tape T shown in FIG. 10C is eventually printed into a desired label R2 which is distinguished from the label R1 only in having a leading background portion BGS(W) and a trailing background portion BGE(W) instead of the leading background portion BGS(Y) and the trailing background portion BGE(Y). In this case, however, at the start of the present label-forming process, there remains a blank portion downstream (leftward as viewed in FIG. 10A) of the printing position Pp. Even when a ground image was set to the background image in the immediately preceding label-forming process, and as a result, the remaining extra printed portion RSGE is left as the leading edge portion of the tape T, at least a portion continuous with the trailing edge of the remaining extra printed portion RSGE is blank (printed with a blank image). Therefore, in the case of the blank image being set to the background image in the present label-forming process, if at least part of the blank portion can be utilized as part of the background image, it is possible to reduce waste of the tape T.

To do this, as will be described in detail hereinafter, the tape printing apparatus 1 is controlled such that the blank portion downstream (leftward as viewed in FIG. 10A) of the printing position Pp can be utilized when the blank image is set to the background image in the present label-forming process. However, when a ground image was set to the background image in the immediately preceding label-forming process, the remaining extra printed portion RSGE is left as the leading edge portion of the tape T as described above, so that the apparatus 1 is controlled to prevent the remaining extra printed portion RSGE from being left. More specifically, first, the length of the remaining extra printed portion RSGE is set to a predetermined extra print length LA ($LA=LAE+\alpha$, where $\alpha$ is a predetermined value which is equal to or larger than "0"), and in the present label-forming process, the leading end-cutting operation is performed such that the tape T is cut at a location thereon rearward away from the leading edge thereof by the extra print length LA. This makes it possible to prevent the ground image in the immediately preceding label-forming process (i.e. the remaining extra printed portion RSGE) from remaining until after the leading end-cutting operation is carried out in the present label-forming process. It should be noted that the predetermined value a may be set, allowing for a tolerance (margin of error) of the cutting position Pc. For instance, even if the cutting position Pc for the leading end-cutting operation is not so accurate, so long as the predetermined value $\alpha$ is set to a value which is slightly larger than this tolerance, it is possible to prevent the ground image in the immediately preceding label-forming process from remaining. In short, even when a blank image is set to the background image in the present label-forming process, it is possible to obtain a label which looks neat up to the leading cut edge thereof.

Thus, the tape printing apparatus 1 makes it possible to print a print image having e.g. a main image and a background image forming the background of the main image on a tape, and to make the background image appear to be a ground image, such as a ground color or a background pattern, of its own. Further, in the apparatus 1, if the tape is not required to appear to have a ground color or a background pattern, it is possible to reduce waste of the tape and to obtain a label which looks neat up to the leading cut edge thereof, even if the cutting position Pc is not so accurate. Next, the image printing process (S50 in FIG. 6) for obtaining the nice-looking label will be described in detail by giving some examples of various printing conditions.

Figure 11:
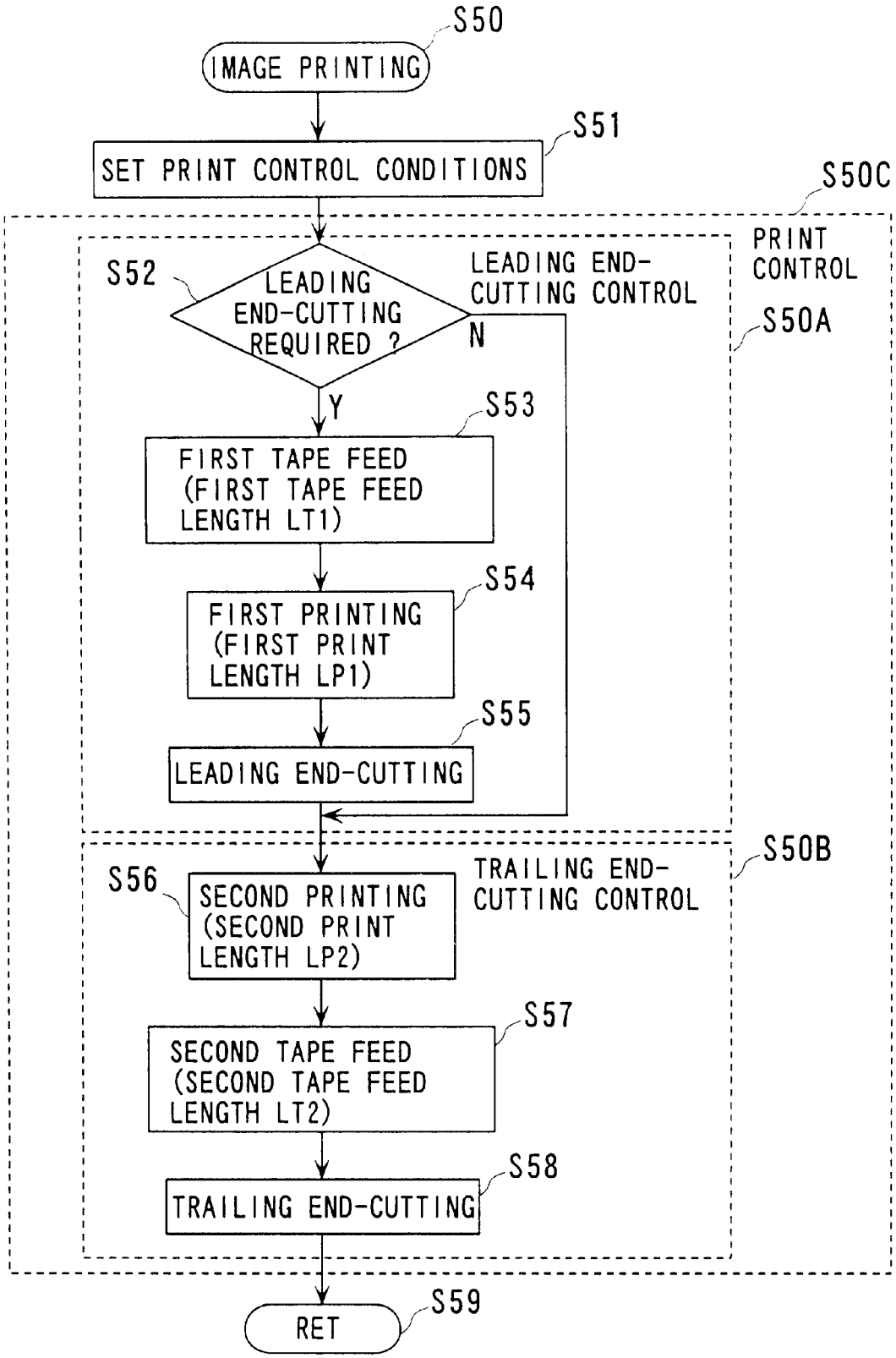
FIG. 11 is a flowchart showing an example of the image-printing process in FIG. 6.
Figures 13A, 13B, 13C, 13D, 13E, 13F:
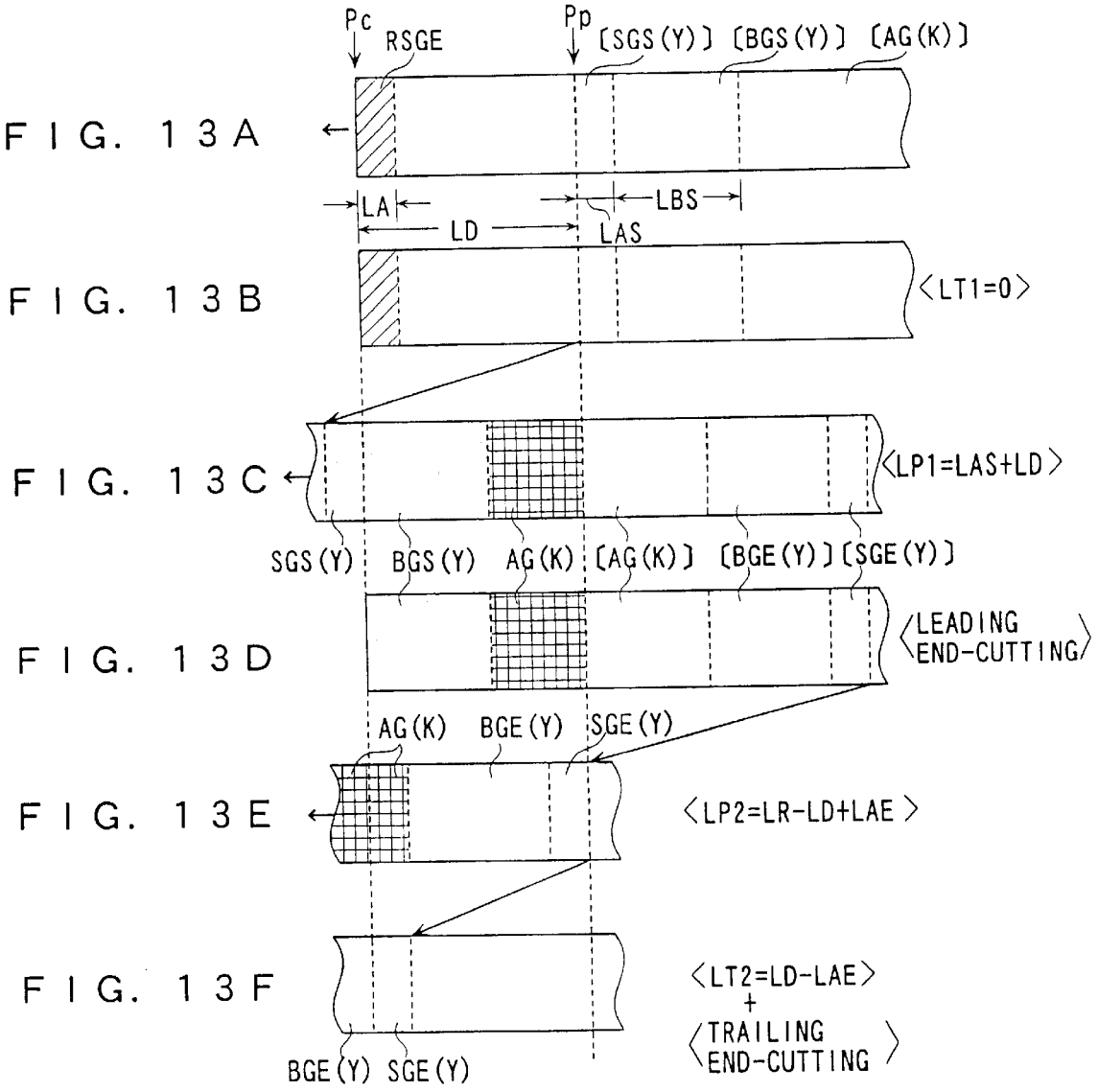
FIGS. 13A to 13F are diagrams illustrating an example of a control process which is executed in the case of the FIG. 11 image-printing process being executed based on Printing conditions set No. 1 in FIG. 12.

Referring to FIG. 11, there is shown an example of the image printing process (S50). As shown in the figure, first, print control conditions are set at step S51, and then print control is carried out at step S50C, followed by terminating the process at step S59. At step S51 of this image printing process, based on a selected set of printing conditions shown in a left group of columns in the FIG. 12 table, i.e. a set of predetermined printing conditions including a condition of whether or not a ground image is set to the background image in the present label-forming process, a corresponding set of print control conditions for printing the print image as shown in a right group of columns in a FIG. 12 table is set.

At the following step S50C where print control is executed, based on the print image formed by the print image-forming process at step S40 in FIG. 6 described above (print image data representative of the print image, to be precise), and the print control conditions set at step S51, the printer block (printing means for performing printing by the print head 7 while feeding the tape T downstream) 12 is controlled to perform the feeding of the tape T as well as various printing operations including the main printing and the extra printing, and at the same time, the cutter 51 of the cutter block 13 for cutting the tape T at the cutting position Pc is controlled to perform various cutting operations including the leading end-cutting operation (S50A) and the trailing end-cutting operation (S50B).

More specifically, in the print control process (S50C), as shown in FIG. 11, first, a leading end-cutting control process for controlling the label-forming process until the leading edge of the label to be made, the leading edge of the tape T, and the cutting position Pc coincide with each other is carried out at step S50A, and after completion of the leading end-cutting control process, a trailing end-cutting control process for controlling the label-forming process until execution of the trailing end-cutting operation is carried out at step S50B. In general, the so-called leading end-cutting operation is an operation for cutting the tape T at a leading edge of a label to be produced. Therefore, after the leading end-cutting operation, the leading edge of the label to be produced, the leading edge of the tape T, and the cutting position Pc at which the tape T is to be cut by the cutter 51 coincide with each other. In other words, if these three are coincident with each other before the leading end-cutting operation, it is possible to omit the leading end-cutting operation. That is, the leading end-cutting control process in the embodiment also includes a control process for omitting the leading end-cutting process.

In this case, since the trailing end-cutting control process (S50B) is executed after completion of the leading end-cutting control process (50A), the leading edge of the label to be produced, the leading edge of the tape T, and the cutting position Pc are coincident with each other at the start of the trailing end-cutting control process (S50B). Further, in this state, a portion of the label to be made, which has the length of the head-to-cutter distance LD of the whole label length (i.e. the print image length) LR, has already been fed downstream of the printing position Pp at which the print head 7 carries out the printing operation. This means that the portion having the length of the head-to-cutter distance LD can be provided (produced) by the leading end-cutting control process (S50A) and the remainder of the label which has a length of LR−LD can be provided (produced) by the trailing end-cutting control process (S50B), i.e. that it is possible to execute these control processes as respective separate control processes.

Still more specifically, as shown in FIG. 11, in the leading end-cutting control process (S50A), first at step S52, it is determined whether or not the leading end-cutting operation is required to be carried out in the present label-forming process. If it is required (Yes to S52), at the following step S53, first tape feed for feeding the tape T downstream by a first tape feed length LT1 (LT1 0) without printing (or while printing a blank image) is carried out. Then, after completion of the first tape feed, first printing for printing while feeding the tape T downstream by a first tape print length LP1 (LP1 0) is carried out at step S54, followed by the leading end-cutting operation being performed at step S55. These processes can be easily controlled since the print control conditions include the first tape feed length LT1 and the first print length LP1 as shown in FIG. 12. That is, the first tape feed (S53) and the first printing (S54) can be performed simply by feeding the tape T by the first tape feed length LT1 and the first print length LP1, respectively. It should be noted that in the first tape feed (S53), the tape T may be simply fed without printing, or alternatively, a blank image may be printed on the tape T to thereby cause the tape T to be fed actually (eventually) without printing.

Further, in this case, the first tape feed length LT1 is equal to or larger than 0 (that is, LT1 includes "0"), so that even when the first printing (S54) is required to be started just from the leading edge of the tape T (i.e. without carrying out the first tape feed (S53) with no printing), so long as the first tape feed length LT1 is set to "0" as a print control condition, it is possible to address the requirement by the identical control process (S50A). Similarly, in the first printing (S54) in which LP1 includes "0", when the operation of the first printing is not required, so long as the first print length LP1 is set to "0" as a printing condition, it is possible to omit the operation by the identical control process (S51). Thus, in the tape printing apparatus 1, even when there are variations in the predetermined printing conditions including a condition of whether or not a ground image is set to the background image as shown in the left column group in FIG. 12, it is possible to deal with any type of image printing by the identical control process (50A) by setting print control conditions associated with each image to be printed, according to corresponding printing conditions for the image (S51). In the following description, correspondences between the lengths LT1 and LP1 and operations are additionally noted as required.

On the other hand, when it is determined at step S52 whether or not the leading end-cutting operation is required to be carried out in the present label-forming process, and the answer to the question is negative (No to S52), the processing up to the leading end-cutting operation (S55) is omitted. As a result, the overall processing time period can be reduced. Further, since the leading edge of the tape T at the start of the present label-forming process is in the state of the tape T having undergone the trailing end-cutting operation in the immediately preceding label-forming process (i.e. at the cutting position Pc), if the first tape feed length LT1 and the first print length LP1 are each equal to "0" (LT1=LP1=0), it is determined that the leading end-cutting process is not required. In short, if LT1=LP1=0 holds, the processing time period can be reduced by omitting the first tape feed (S53), the first printing (S54), and the leading end-cutting operation (S55), though execution of these processes would have no adverse effect on the overall label-forming process except that the leading end-cutting operation (S55) produces no results.

In the following trailing end-cutting control process (S50B), after completion of the leading end-cutting control process (S50A), second printing for printing while feeding the tape T downstream by a second tape print length LP2 (LP2 0) is carried out at step S56, and then second tape feed for feeding the tape T downstream by a second tape feed length LT2(LT2 0) without printing (or while printing a blank image) is carried out at step S57, followed by the trailing end-cutting operation being executed at step S58. Similarly to the case of the leading end-cutting control process (S50A), these operation can be easily controlled since the print control conditions include the second tape feed length LT2and the second print length LP2 as shown in FIG. 12. That is, the second tape feed (S56) and the second printing (S57) can be performed simply by feeding the tape T by the second tape feed length LT2and the second print length LP2, respectively. Further, in the second tape feed (S57), similarly to the first tape feed (S53), the tape T may be simply fed without printing, or alternatively, a blank image may be printed on the tape T to thereby cause the tape T to be fed actually (eventually) without printing.

Further, the second print length LP2and the second tape feed length LT2are each equal to or larger than 0 (that is, LP2and LT2each include "0"), so that when the second printing and tape feed are not required, so long as the lengths LP2and LT2are each set to "0" as a printing condition, it is possible to omit these operations by the identical control process (S50B). Thus, in the tape printing apparatus 1, even when there are variations in the predetermined printing conditions including a condition of whether or not a ground image is set to the background image as shown in the left column group in FIG. 12, it is possible to produce a label through the identical control processes (50A and 50B) by setting print control conditions associated with each image to be printed, according to corresponding printing conditions for the image (S51). In the following description, correspondences between the lengths LT2and LP2and operations are additionally noted as required.

Next, the print control process (S50C) described above with reference to FIG. 11 will be described in more detail with reference to FIGS. 13A to 18F, following the respective printing conditions (in numerical order).

First, when a first set of printing conditions (Printing conditions set No. 1) in FIG. 12 are satisfied, i.e. when a ground image is set to the background image in the present label-forming process, the extra printing is carried out over the leading extra print length LAS (i.e. an amount corresponding to the leading extra print portion SGS(Y)) by the leading end-cutting control process (S50A in FIG. 11), and then the main printing is carried out from the leading edge of the print image over the length of the head-to-cutter distance LD (Yes to S52; LT1=0 at step S53 and; LP1= LAS+LD at step S54 in FIG. 11; see FIGS. 13A to 13C), followed by the leading end-cutting operation being executed at S55 (see FIG. 13D).

Thus, when a ground image is set to the background image in the present label-forming process, the ground image continuous with the background image can be printed by the extra printing on the tape T from the location the predetermined leading extra print length LA forward of the leading edge of the print image to the leading edge of the print image (i. e. on the leading extra print portion SGS (Y)), and then the leading end-cutting operation (S55) can be executed (see FIG. 13D) at the leading edge of the print image (i.e. the leading edge of the leading background image BGS(Y) which is the trailing edge of the leading extra print portion SGS(Y)). As a result, it is possible to obtain a label having the ground image printed thereon beautifully up to its leading cut edge even if the cutting position for the leading end-cutting operation is not so accurate. It should be noted that in general the extra print length LA required for making neat the appearance of a leading cut edge of a label may be smaller than the head-to-cutter distance LD. Therefore, in the present embodiment, if only LA LD is set as a printing condition, regardless of whether or not a ground image was set to the background image in the immediately preceding label-forming process, the leading end-cutting operation is carried out at a location on the tape T which is rearward of the leading edge of the same by a length equal to or larger than the predetermined extra print length LA.

When the conditions of Printing conditions set No. 1 in FIG. 12 are satisfied (i.e. when the ground image is set to the background image in the present label-forming process), in the trailing end-cutting control process (S50B in FIG. 11)

executed after completion of the leading end-cutting control process (S50A), the main printing is carried out over a length of LR−LD of the whole print image length LR. Then, the extra printing is carried out by over the trailing extra print length LAE (i.e. on the trailing extra print portion SGE(Y) (S56 in FIG. 11: LP2=LR−LD+LAE (see FIG. 13E)), followed by the trailing end-cutting operation being executed at S58.

Thus, when the ground image is set to the background image in the present label-forming process, the ground image continuous with the background image can be printed by the extra printing on the tape T from the trailing edge of the print image to the location on the tape T which is rearward of the trailing edge of the print image by the predetermined trailing extra print length LAE (i.e. on the trailing extra print portion SGE(Y)), and then the trailing end-cutting operation can be executed at the trailing edge of the print image (i.e. the trailing edge of the trailing background image BGE(Y) which is the leading edge of the trailing extra print portion SGE(Y)) (S58). As a result, it is possible to obtain a label having the ground image printed thereon beautifully up to its trailing cut edge even if the accuracy of the cutting position for the trailing end-cutting operation is not high.

Next, second to sixth sets of printing conditions (Printing conditions set No. 2 to No. 6) in FIG. 12 will be described. If a blank image is set to the background image in the present label-forming process, the main printing to be carried out over a leading blank length (leading background length in the case of a blank image being set to the background image) LBS between the leading edge of the print image and the leading edge of the main image is omitted under any of Printing conditions sets No. 2 to No. 6. In short, in the case of the blank image being set to the background image, the portion of the tape T between the leading edge of the print image and the leading edge of the main image has the blank image thereon, and hence it is possible to omit the main printing on the portion having the leading blank length LBS.

In general, in the state of the trailing end-cutting operation having been executed in the immediately preceding label-forming process (i.e. at the start of the leading end-cutting control process in the present label-forming process), a blank portion (non-printed area) remains on the tape T between the printing position Pp for printing by the print head 7 and the cutting position Pc for cutting by the cutter 51 (i.e. a head-to-cutter portion of the tape T at the start of the present leading end-cutting control process). If the main printing carried out on the portion of the tape T having the leading blank length LBS is omitted, it is not required to make the leading edge of the print image coincident with the printing position Pp at the start of the leading end-cutting control process (S50A in FIG. 11), and hence it is possible to regard part or all of the blank portion on the head-to-cutter portion of the tape T as part or all of the blank image having the leading blank length LBS. This means that omission of the main printing to be carried out on the portion of the tape T having the leading blank length LBS makes it possible to utilize part or all of the portion of the tape T having the length of the head-to-cutter distance LD as a portion of the label to be produced, as a result of which waste of the tape T can be reduced differently from the case of the main printing being carried out on the portion having the length LBS.

Figures 14A, 14B, 14C, 14D, 14E, 14F:
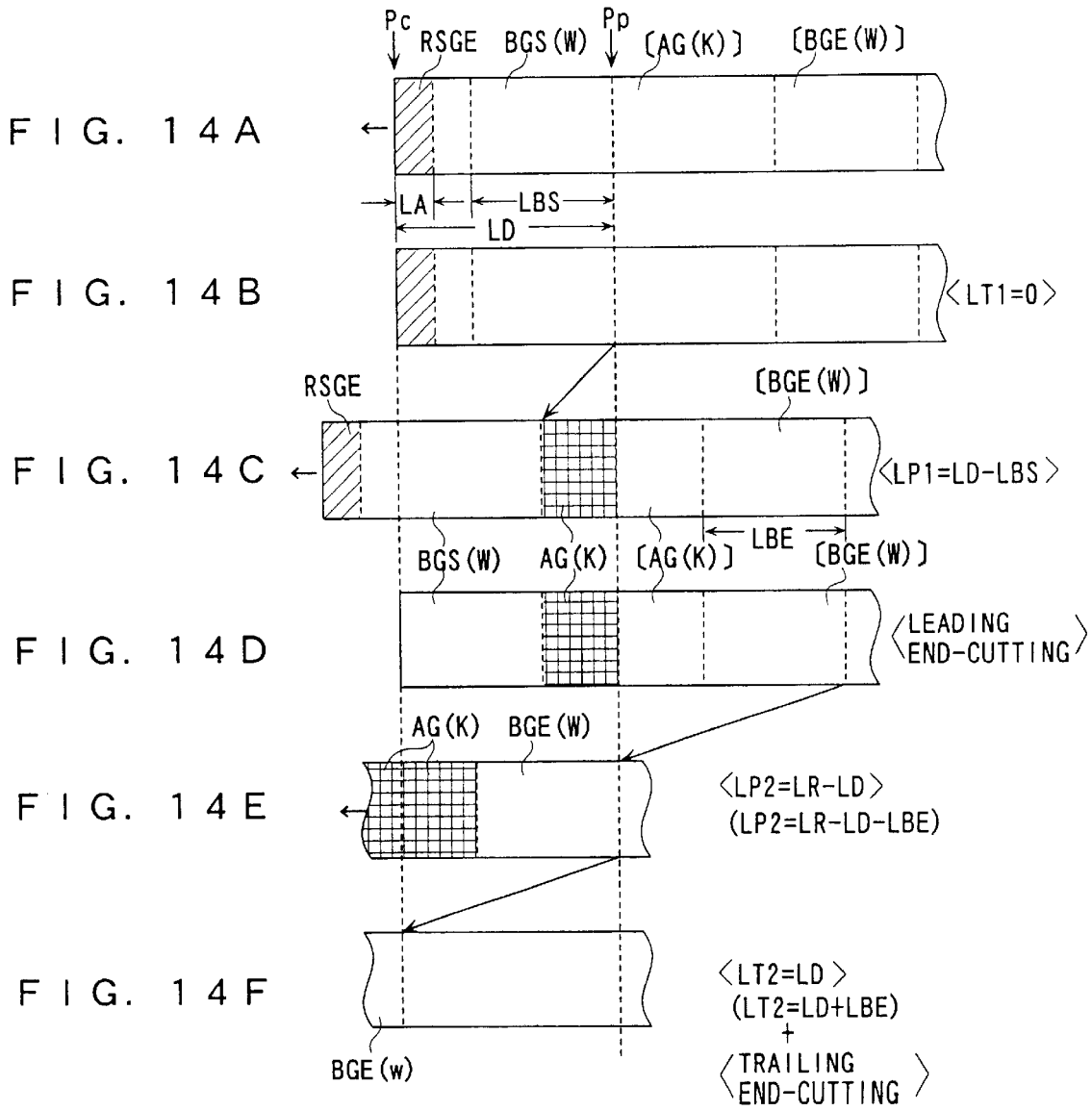
FIGS. 14A to 14F are diagrams illustrating an example of the control process which is executed in the case of the FIG. 11 image-printing process being executed based on Printing conditions set No. 2 in FIG. 12.

Referring first to Printing conditions set No. 2 in FIG. 12, if the conditions thereof are satisfied, i.e. if a blank image is set to the background image in the present label-forming process, with the relationship between the head-to-cutter distance LD, the extra print length LA, and the leading blank length LBS being expressed by LD−LA>LBS, regardless of the settings in the immediately preceding label-forming process, by the leading end-cutting control process (S50A in FIG. 11), (Yes to S52; and LT1=0 at step S53; see FIG. 14A to 14B, and) the main printing is carried out over a length of LD−LBS (=LP1) from the leading edge of the main portion AG(K) (i.e. the leading edge of the main image AGG(K)) at step S54 (see FIG. 14C), followed by the leading end-cutting operation being executed at step S55 (see FIG. 14D).

As described above, as a result of the trailing end-cutting control process in the immediately preceding label-forming process, there remains a portion of the tape T having the length of the head-to-cutter distance LD between the print head 7 and the cutter 51 at the start of the leading end-cutting control process (S50A) in the present label-forming process. Accordingly, when in this state, (the first print length LT1 is set to "0" at step S53, and) the main printing is carried out from the leading edge of the main portion AG(K) (i.e. the leading edge of the main image AGG(K)) over the length (LP1=) LD−LBS at step S54, this results in a state in which a portion of the tape T having a length of 2LD−LBS (=LD−LBS+LD) exists downstream of the printing position Pp, with a portion thereof having a length of LD−LBS existing downstream of the cutting position Pc (see FIG. 14C). Therefore, when the leading end-cutting operation is executed (S55 in FIG. 14) in this state, the portion of the tape T having the length of LD−LBS is cut off.

When the ground image is set to the background image in the immediately preceding label-forming process, as a result of the trailing extra printing in this process, there is left a portion of the ground image having the trailing print length LAE on a leading edge portion of the tape T at the start of the leading end-cutting control process (see FIG. 14A). However, the tape T has its leading edge portion with the length of LD−LBS cut off, and LD−LA>LBS, therefore, LD−LBS>LA (=LAE+α), so that it is possible to prevent the ground image set to the background image in the immediately preceding label-forming process from remaining until after the leading end-cutting operation (see FIG. 14D).

Further, in this case, the tape T of the heat-to-cutter length LD left between the print head 7 and the cutter 51 after the leading end-cutting operation (S55) is printed with a portion of the print image having the length of LD−LBS from the leading edge of the main portion AG(K) thereof (i.e. from the leading edge of the main image AGG(K)) in a manner continuous with the blank image (i.e. the leading blank portion BGS(W)) having the leading blank length LBS from its leading edge (i.e. from the leading cut edge at the cutting position Pc) (see FIG. 14D). Thus, omission of the main printing over the leading blank length LBS makes it possible to utilize the portion (i.e. the leading blank portion BGS(W)) of the tape T having the length LBS out of the length of the head-to-cutter distance LD, as a portion of the label to be produced, as a result of which waste of the tape T can be reduced differently from the case of the main printing being effected on the portion having the length LBS, and it is possible to obtain a label neatly produced up to its leading cut edge.

If the conditions of Printing conditions set No. 2 in FIG. 12 (commonly to Printing conditions sets No. 3 to No. 6 with respect to the setting of a ground image in the present label-forming process, as described hereinafter) are satisfied, i.e. when the blank image is set to the background image in the present label-forming process, in the trailing end-cutting control process (S50B) subsequent to the above process (S50A), the main printing is carried out or continued over the length of (LP2=) LR−LD at step S56 (see FIG. 14E) after completion of the leading end-cutting control process (S50A), and then the tape T is fed by the length of (LT2=) LD at step S57 (see FIG. 14F), followed by the trailing end-cutting operation being executed at step S58.

As described above, at the start of the trailing end-cutting control process (S50B), the leading edge of the label to be produced, the leading edge of the tape T, and the cutting position Pc are coincident with each other, and a portion of the label having the length of the head-to-cutter distance LD of the whole label length (i.e. the print image length) LR has already been fed downstream of the printing position Pp for printing by the print head 7, so that by carrying out the main printing over the length of (LP2) LR−LD at step S56, the overall printing of the print image is completed (see FIG. 14E).

Further, at the completion of the main printing, the trailing edge of the print image (i.e. the trailing edge of the trailing blank portion BGE(W)) is at the printing position Pp for printing by the print head 7, so that when the tape T is fed by the length of (LT2=) LD at step S57 after the completion of the main printing, the trailing edge of the print image (the trailing edge of the trailing blank portion BGE(W) ) coincides with the cutting position Pc (see FIG. 14F). Accordingly, by cutting the tape T in this state, it is possible to cut the tape T at the trailing edge of the print image. That is, the above control process (S50B) makes it possible to complete the overall printing (main printing) of the desired print image and then carry out the trailing end-cutting operation (S58) to cut the tape T at the trailing edge of the print image.

Concerning any of Printing conditions sets No. 2 to No. 6, when a blank image is set to the background image in the present label-forming process, it is possible to omit the main printing to be effected on the portion of the print image having the trailing blank length (i.e. the trailing background length in the case of a blank image being set to the background image) LBE between the trailing edge of the main portion AG(K) (i.e. the trailing edge of the main image AGG(K)) and the trailing edge of the whole print image (i.e. the main printing on the trailing blank portion BGE(W)) in the trailing end-cutting control process (S50B in FIG. 11) (which actually means omission of control of the main printing on the trailing blank portion BGE(W) since it is a non-printed area), and to carry out tape feed without printing instead of effecting the main printing. More specifically, in the trailing end-cutting control process (S50B) in this case, the main printing is carried out over a length of (LP2=) LR−LD−LB at step S56 after the completion of the leading end-cutting control process (S50A), and then the tape T is fed by a length of (LP2=) LD+LBE at step S57, followed by the trailing end-cutting process being executed at step S58.

As described above, at the start of the trailing end-cutting control process (S50B), the portion of the label having the length of the head-to-cutter distance LD of the print image length LR has already been fed downstream of the printing position Pp for printing by the print head 7, so that by carrying out the main printing (printing of the print image, i.e. printing of the main portion AG(K)) over the length of (LP2=) LR−LD−LB at step S56 after the completion of the leading end-cutting control process (S50A), the overall printing of the print image is completed. At this time point, the trailing edge of the main portion AG(K) (i.e. the main image AGG(K)) is at the printing position Pp, so that when the tape T is fed by the length of (LP2=) LD+LBE at the following step S57, the trailing edge of the print image (i.e. the trailing edge of the trailing blank portion BGE(W)) coincides with the cutting position Pc. Accordingly, by cutting the tape T in this state, it is possible to cut the tape T at the trailing edge of the print image. That is, it is possible to complete the overall printing (main printing) of the desired print image while omitting printing of the blank image, and to carry out the trailing end-cutting operation (S58) for cutting the tape T at the trailing edge of the print image.

Figures 15A, 15B, 15C, 15D, 15E, 15F:
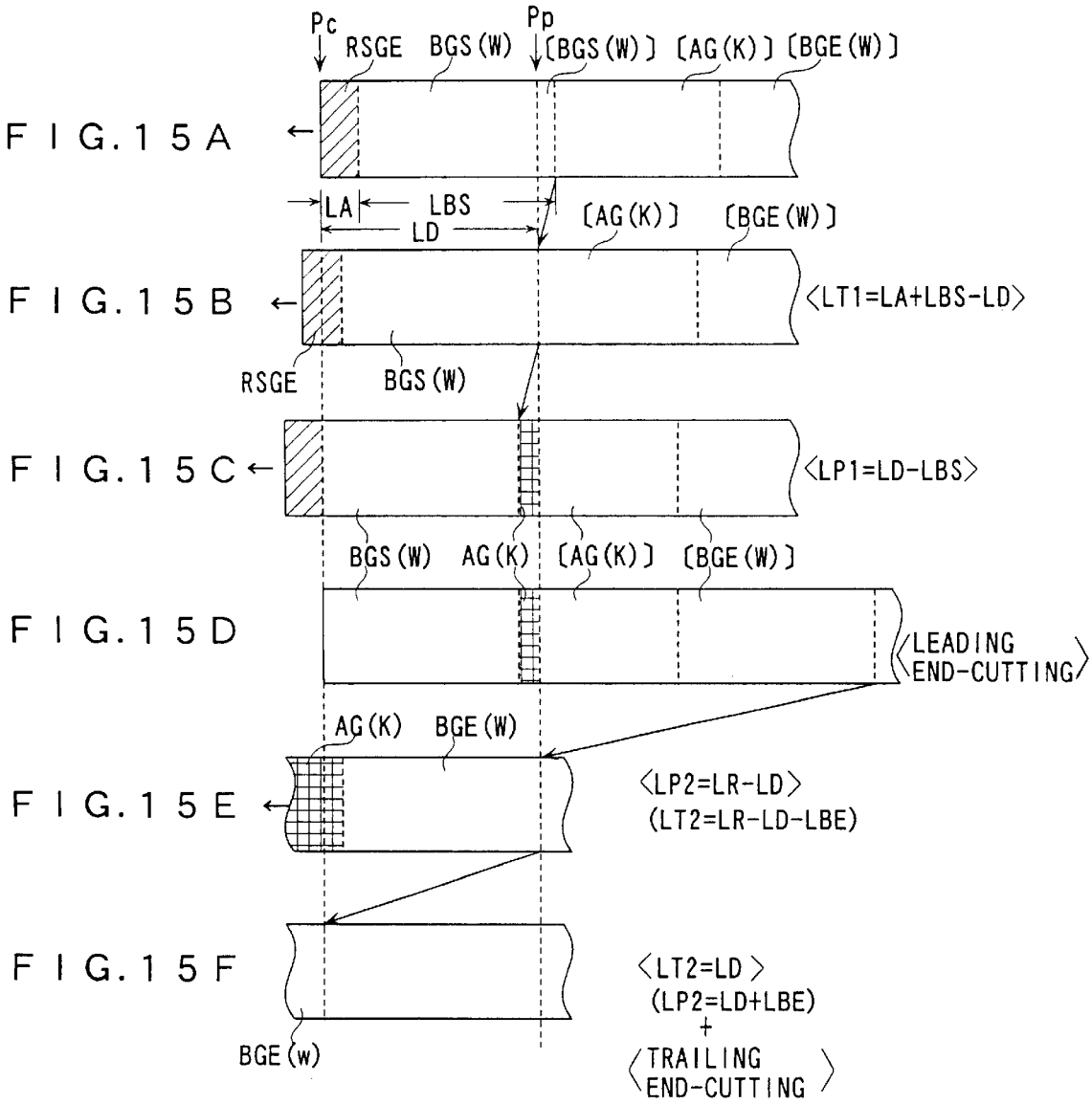
FIGS. 15A to 15F are diagrams illustrating an example of the control process which is executed in the case of the FIG. 11 image-printing process being executed based on Printing conditions set No. 3 in FIG. 12.

Next, referring to Printing conditions set No. 3 in FIG. 12, if the conditions thereof are satisfied, i.e. if a blank image is set to the background image in the present label-forming process and a ground image was set to the background image in the immediately preceding label-forming process, with the relationship between the head-to-cutter distance LD, the extra print length LA, and the leading blank length LBS being expressed by LD−LA LBS<LD, in the leading end-cutting control process (S50A), after it is determined that the answer to the question of step S52 is affirmative (Yes), the tape T is fed by a length of (LT1=) LA+LBS−LD at step S53 (see FIG. 15A to 15B), and then main printing is carried out from the leading edge of the main portion AG(K) (i.e. the leading edge of the main image AGG(K)) over the length of (LP1=) LD−LBS at step S54 (see FIG. 15C), followed by the leading end-cutting operation being executed at step S55 (see FIG. 15D).

Similarly to the case of Printing condition set No. 2 described above, when the tape T is fed by the length of (LT1=) LA+LBS−LD at step S53 in the state of the portion of the tape T having the length of the head-to-cutter distance LD being left between the print head 7 and the cutter 51 at the start of the leading end-cutting control process (S50A) in the present label-forming process, this results in a state in which a portion of the tape T having a length of LA+LBS exists downstream of the printing position Pp, with a portion thereof having a length of LD+LBS−LD existing downstream of the cutting position Pc (see FIG. 15B). Further, when the main printing is carried out from the leading edge of the main portion AG(K) (i.e. the leading edge of the main image AGG(K)) over the length of (LP1=) LD−LBS at step S54, this results in a state in which a portion of the tape T having a length of LA+LD exists downstream of the printing position Pp, with a portion thereof having a length of LA existing downstream of the cutting position Pc (see FIG. 15C). Therefore, when the leading end-cutting operation is executed in this state at step S55 (see FIG. 15D), the portion of the tape T having the length of LA is cut off.

When a ground image was set to the background image in the immediately preceding label-forming process, a portion of the ground image having the extra print length LAE remains on the leading edge portion of the tape T at the start of the leading end-cutting process (S50A) in the present label-forming process, as described above. However, the leading end portion of the tape T having the extra print length LA (=LAE+$\alpha$) is cut off by the leading end-cutting operation (S55), so that it is possible to prevent the ground image from remaining until after the leading end-cutting operation (see FIG. 15D). Further, in this case, a portion of the tape T having the heat-to-cutter length LD left between the print head 7 and the cutter 51 after the leading end-cutting operation (S55) is printed with the portion of the print image having the length of LD−LBS from the leading edge of the main portion AG(K) in a manner continuous with the leading blank image portion BGS(W) extending from the leading cut edge (see FIG. 15D). Therefore, the portion (leading blank image portion BGS(W)) of the tape T having the length LBS out of the length of the head-to-cutter distance LD can be utilized as a portion of the label to be produced, which enables reduction of waste of the tape T and makes it possible to obtain a label neatly produced up to its leading cut edge. The trailing end-cutting control process (S50B) is executed in the same manner as in the case of Printing conditions set No. 2 in FIG. 12 described hereinabove, so that description thereof is omitted (see FIG. 15E to 15F).

Figures 16A, 16B, 16C, 16D, 16E, 16F:
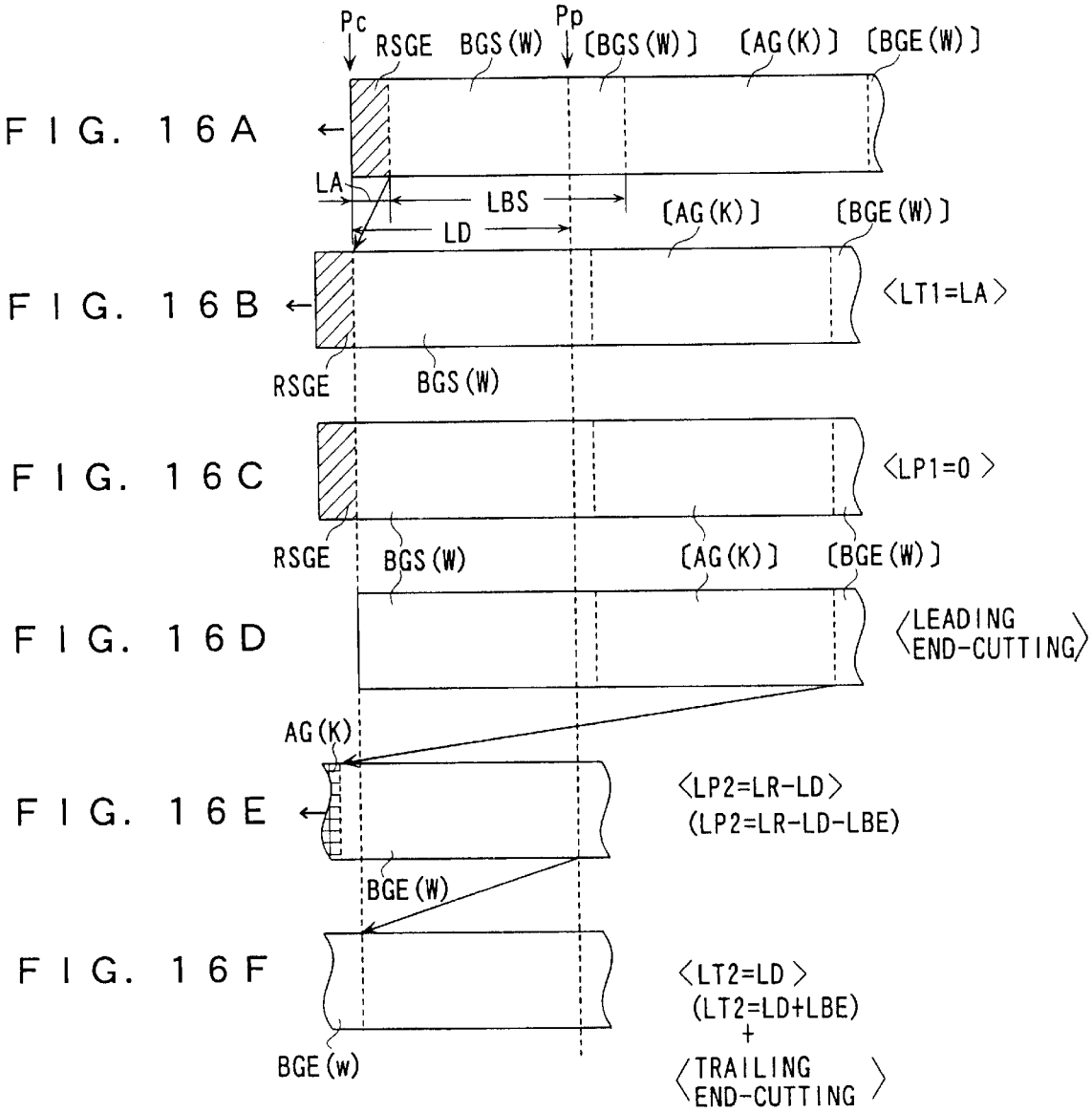
FIGS. 16A to 16F are diagrams illustrating an example of the control process which is executed in the case of the FIG. 11 image-printing process being executed based on Printing conditions set No. 4 in FIG. 12.

Next, referring to Printing conditions set No. 4 in FIG. 12, when the conditions thereof are satisfied, i.e. if a blank image is set to the background image in the present label-forming process and a ground image was set to the background image in the immediately preceding label-forming process, with the relationship between the head-to-cutter distance LD and the leading blank length LBS being expressed by LD LBS, in the leading end-cutting control process (S50A), after it is determined that the answer to the question of step S52 is affirmative (Yes), the tape T is fed by a length of (LT1=) LA at step S53 and the first print is skipped at step S54 (LP1=0) (see FIGS. 16A to 16C)), followed by the leading end-cutting operation being executed at step S55 (see FIG. 16D). In this case, similarly to the case of Printing conditions set No. 2, when the tape T is fed by the length of (LT1=) LA at step S53 from the state of a portion of the tape T having the length of the head-to-cutter distance LD being left between the print head 7 and the cutter 51 at the start of the leading end-cutting control process (S50A) in the present label-forming process, this results in a state in which a portion of the tape T having the length of LA+LD exists downstream of the printing position Pp. with a portion thereof having the length of LA existing downstream of the cutting position Pc (see FIG. 16B). Therefore, when the leading end-cutting operation is executed in this state (and after executing the step S55 (LP1=0) (see FIG. 16D) ), the portion of the tape T having the length of LA is cut off.

When a ground image was set to the background image in the immediately preceding label-forming process, a portion of the ground image having the extra print length LAE remains on the leading edge portion of the tape T at the start of the leading end-cutting control process in the present label-forming process, as described above. However, the leading end portion of the tape T having the extra print length LA (=LAE+$\alpha$) is cut off by the leading end-cutting operation (S55), so that it is possible to prevent the ground image from remaining until after the leading end-cutting operation (see FIG. 16D). Further, since LD LBS holds in this case, the whole portion of the tape T having the heat-to-cutter length LD, which is left between the print head 7 and the cutter 51 after the leading end-cutting operation (S55), is included in the blank image having the leading blank length LBS (i. e. the leading blank image portion BGS(W)) (see FIG. 16D). Therefore, the whole portion of the tape T having the length of the head-to-cutter distance LD can be utilized as a portion of the leading blank image portion BGS(W), which enables reduction of waste of the tape T and makes it possible to obtain a label neatly produced up to its leading cut edge. The trailing end-cutting control process (S50B) is executed in the same manner is in the case of Printing conditions set No. 2 in FIG. 12 described hereinabove, so that description thereof is omitted (see FIG. 16E to 16F).

Figures 17A, 17B, 17C, 17D, 17E, 17F:
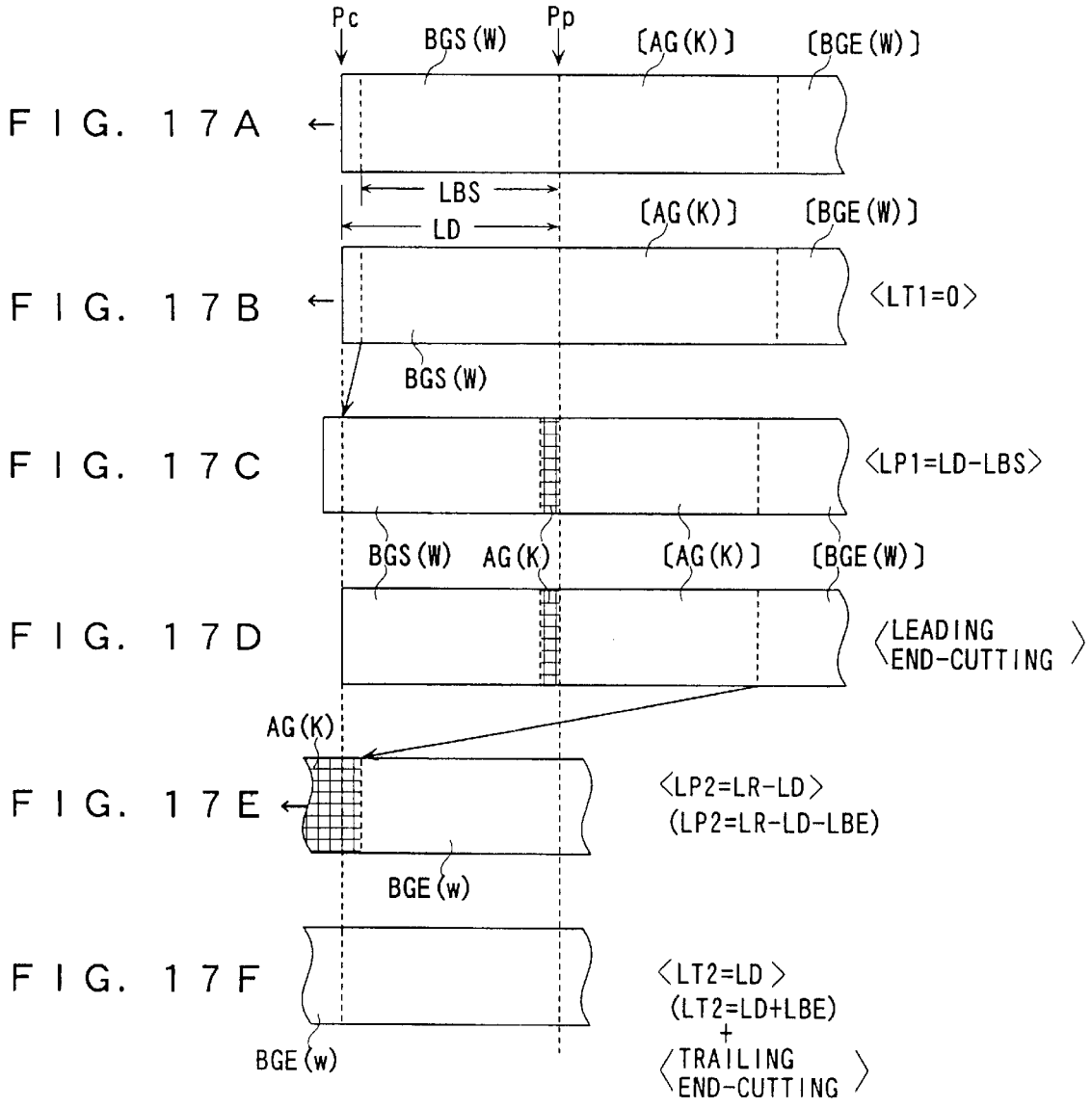
FIGS. 17A to 17F are diagrams illustrating an example of the control process which is executed in the case of the FIG. 11 image-printing process being executed based on Printing conditions set No. 5 in FIG. 12.
Figures 18A, 18B, 18C, 18D, 18E, 18F:
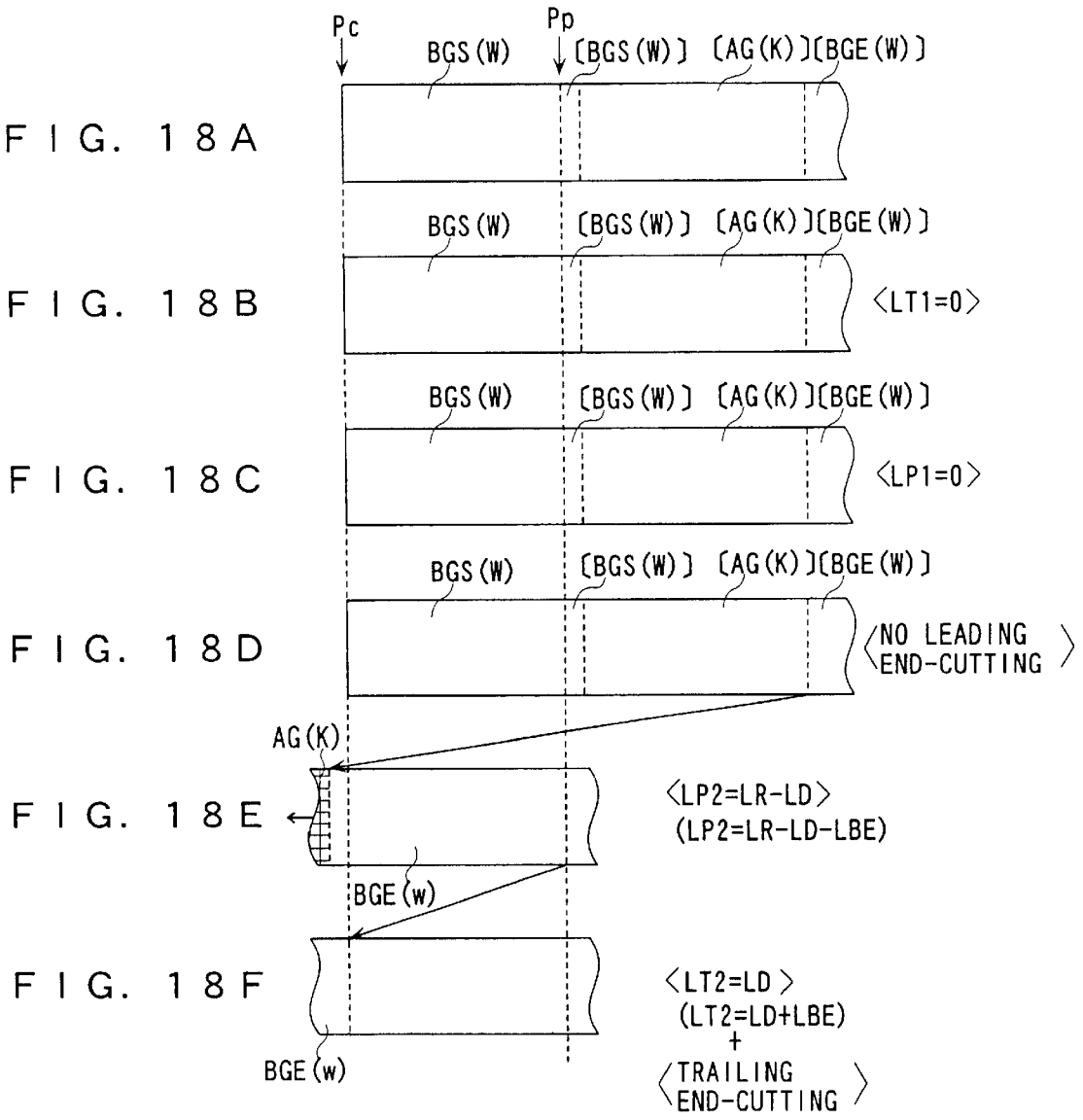
FIGS. 18A to 18F are diagrams illustrating an example of the control process which is executed in the case of the FIG. 11 image-printing process being executed based on Printing conditions set No. 6 in FIG. 12.

Next, referring to Printing conditions set No. 5 in FIG. 12, if the conditions thereof are satisfied, i.e. if a blank image is set to the background image in the present label-forming process and when a blank image was set to the background image in the immediately preceding label-forming process, with the relationship between the head-to-cutter distance LD and the leading blank length LBS being expressed by LD>LBS, in the leading end-cutting control process (S50A), after it is determined that the answer to the question of step S52 is affirmative (Yes), the first tape feed is skipped (LT1=0) at step S53 (see FIGS. 17A and 17B), and the main printing is carried out over the length of (LP1=) LD−LBS from the leading edge of the main portion AG(K) at step S54 (see FIG. 17C)), followed by the leading end-cutting operation being executed at step S55 (see FIG. 17D). In this case, similarly to the case of Printing conditions set No. 2, when the first tape feed is skipped at step S53 (LT1=0) and the main printing is carried out over the length of (LP1=) LD−LBS from the leading edge of the main portion AG(K) at step S54 in the state of a portion of the tape T having the length of the head-to-cutter distance LD being left between the print head 7 and the cutter 51 at the start of the leading end-cutting control process (S50A) in the present label-forming process, this results in a state in which a portion of the tape T having the length of 2LD−LBS (=LD−LBS+LD) exists downstream of the printing position Pp, with a portion thereof having the length of LD−LBS existing downstream of the cutting position Pc (see FIG. 17C). Therefore, when the leading end-cutting operation is executed in this state at step S55 (see FIG. 17D), the portion of the tape T having the length of LD−LBS is cut off.

In this case, since no ground image was set to the background image in the immediately preceding label-forming process, there is no ground image remaining at the start of the leading end-cutting control process in the present label-forming process. Further, in this case, the portion of the tape T having the heat-to-cutter length LD left between the print head 7 and the cutter 51 after the leading end-cutting operation (S55) is printed with the portion of the print image having the length of LD−LBS from the leading edge of the main portion AG(K) in a manner continuous with the leading blank image portion BGS(W) extending from the leading cut edge (see FIG. 17D). Therefore, the portion of the tape T having the length LBS out of the length of the head-to-cutter distance LD (i. e. the leading blank image portion BGS(W)) can be utilized as a portion of the label to be produced, which enables reduction of waste of the tape T and makes it possible to obtain a label neatly produced up to its leading cut edge. The trailing end-cutting control process (S50B) is executed in the same manner as in the case of Printing conditions set No. 2 is FIG. 12 described hereinabove, so that description thereof is omitted (see FIG. 17E to 17F).

Finally, referring to Printing conditions set No. 6 in FIG. 12, if the conditions thereof are satisfied, i.e. if a blank image is set to the background image in the present label-forming process and a black image was set to the background image in the immediately preceding label-forming process, with the relationship between the head-to-cutter distance LD and the leading blank length LBS being expressed by LD LBS, in the leading end-cutting control process (S50A), the steps S53 to S55 before the leading end-cutting operation are skipped (since the answer to the question of the step S52 is negative (No))(see FIGS. 18A to 18D).

In this case, similarly to the case of Printing conditions set No. 2, at the start of the leading end-cutting control process (S50A), there is left a portion of the tape T having the length of the head-to-cutter distance LD between the print head 7 and the cutter 51. However, since a blank image was set to the background image in the immediately preceding label-forming process and the condition of LD LBS holds, the whole portion of the tape T having the heat-to-cutter length LD can be utilized as a portion of the blank image having the leading blank length LBS (i.e. the leading blank image portion BGS(W)), and hence the leading end-cutting operation (S55) can be dispensed with (see FIGS. 18A to 18D). Thus, it is possible to skip the processes (S53 to S55) and utilize the whole portion of the tape T having the length of the head-to-cutter distance LD as part of the leading blank image portion BGS(W) having the length of LBS, which enables reduction of waste of the tape T and makes it possible to obtain a label neatly produced up to its leading cut edge. The trailing end-cutting control process (S50B) is executed in the same manner as in the case of Printing conditions set No. 2 in FIG. 12 described hereinabove, so that description thereof is omitted (see FIG. 18E to 18F).

Although in the above embodiment, the main image is formed by a character image including letters and numerals, an image formed by nonstandard character registration or plotted image registration may be used as the main image. Further, although black color (K) is set to the color of the main image, and yellow color (Y) to the color of the background image, the combination of colors for these images can be selected as desired Moreover, although in the embodiment, a solid color is selected as the ground image set to the background image to make the tape appear to have a ground color of its own, this is not limitative, but a ground image making the tape appear to have a predetermined background pattern of its own may be used as well, and the background patterns may have various colors so long as they can be printed in a continuous manner.

Further, in the above embodiment, the invention is applied to an ink jet printing apparatus, but it can also be applied to a thermal type, a laser type, a dot impact type, and so forth. Still further, as far as a tape to be used for producing labels is concerned, it is possible to use any type of tape which can be printed on and cut into a label, and the label produced is not limited to a self-adhesive one, but it may be one which can be affixed to some object article e.g. by the use of paste.

It is further understood by those skilled in the art that the foregoing are preferred embodiments of the invention, and that various changes and modifications may be made without departing from the spirit and scope thereof.

What is claimed is:

1. A method of controlling a tape printing apparatus that prints a print image composed of a main image and a background image forming a background of said main image, on a tape which is a printing object, and cuts off a printed portion of said tape on which said print image is printed to thereby form a label, the method comprising the steps of:

selectively setting one of a blank image without any image to be printed, and a ground image providing at least one of a ground color of said tape and a background pattern of said tape, to said background image;

carrying out a leading end-cutting operation for cutting said tape at a leading edge of said print image;

printing said print image by a main printing operation; and carrying out a trailing end-cutting operation for cutting said tape at a trailing edge of said print image, wherein when said ground image was set to said background image of an immediately preceding label formed last time, said leading end-cutting operation for a present label to be formed this time is carried out by cutting said tape at a position located at least a predetermined extra print length LA rearward of a leading edge of said tape ($LA=LAE+\alpha$, wherein LAE represents a predetermined trailing extra print length defined as a length of a portion which extends from a trailing edge of said printed portion and on which said ground image continuing from said background image has been printed by an extra printing operation during preparation of said immediately preceding label, and $\alpha$ represents a predetermined value of length equal to or larger than 0).

2. A method according to claim 1, wherein when said ground image is set to said background image of said present label, said ground image is printed from a position located a leading extra print length LAS forward of said leading edge of said print image to said leading edge of said print image, in a manner continuing to said background image, by said extra printing operation, and then said leading end-cutting operation is carried out by cutting said tape at said leading edge of said print image.

3. A method according to claim 1, wherein said tape printing apparatus includes a print head located at a printing position for carrying out printing on said tape by using ink, a feeder device for feeding said tape in a downstream direction, and a cutter located at a cutting position a head-to-cutter distance LD downstream of said printing position of said print head, for cutting said tape, the method including the steps of:

setting print control conditions for control of printing of said print image, based on predetermined printing conditions including a condition of whether said ground image has been set to said background image of said present label; and controlling operation of said feeder device and operation of said print head, based on print image data representative of said print image and said print control conditions, to carry out feeding of said tape and various printing operations including said main printing operation and said extra printing operation, and at the same time controlling operation of said cutter to carry out various cutting operations including said leading end-cutting operation and said trailing end-cutting operation.

4. A method according to claim 3, wherein the step of controlling said operation of said feeder device and said operation of said print head and at the same time controlling said operation of said cutter includes the steps of:

carrying out a leading end-cutting control process such that said leading edge of said tape coincides with said leading edge of said label at said cutting position of said cutter when said leading end-cutting operation is carried out, and carrying out a trailing end-cutting control process for execution of said trailing end-cutting operation, after said leading end-cutting operation.

5. A method according to claim 4, wherein the step of carrying out said leading end-cutting control process comprises the steps of:

carrying out a first tape-feeding operation by feeding said tape in said downstream direction by a first tape feed length LT1(LT1 0) without executing printing or while printing said blank image;

carrying out a first printing operation by feeding said tape in said downstream direction by a first print length LP1 (LP1 0) while executing printing, after said first tape feeding operation; and carrying out said leading end-cutting operation after said first printing operation, wherein said print control conditions include said first tape feed length LT1 and said first print length LP1.

6. A method according to claim 5, wherein the step of carrying out said leading end-cutting control process includes determining whether or not said present label requires said leading end-cutting operation, and omitting said leading end-cutting operation when it is determined that said present label does not require said leading end-cutting operation.

7. A method according to claim 4, wherein the step of carrying out said trailing end-cutting control process comprises the steps of:

carrying out a second printing operation by feeding said tape in said downstream direction by a second tape print length LP2(LP2 0) while executing printing, after termination of said leading end-cutting control process;

carrying out a second tape-feeding operation by feeding said tape in said downstream direction by a second tape feed length LT2(LT2 0) without executing printing or while printing said blank image, after said second printing operation; and carrying out said trailing end-cutting operation after said second tape-feeding operation, p1 wherein said print control conditions include said second print length LP2and said second tape feed length LT2.

8. A method according to claim 4, wherein the step of carrying out said trailing end-cutting control process includes, if said ground image is set to said background image of said present label, carrying out said main printing operation over a length of LR−LD after termination of said leading end-cutting control process, assuming that LR represents a print image length defined as a length of said print image, then carrying out said extra printing operation over said trailing extra print length LAE, then feeding said tape by a length of LD−LAE, and then carrying out said trailing end-cutting operation.

9. A method according to claim 4, wherein the step of carrying out said trailing end-cutting control process includes, if said blank image is set to said background image of said present label, carrying out said main printing operation over a length of LR−LD after termination of said leading end-cutting control process, assuming that LR represents a print image length defined as a length of said print image, then feeding said tape by a length of LD, and then carrying out said trailing end-cutting operation.

10. A method according to claim 4, wherein the step of carrying out said trailing end-cutting control process includes, if said blank image is set to said background image of said present label, carrying out said main printing operation over a length of LR−LD−LBE after termination of said leading end-cutting control process, assuming that LR represents a print image length defined as a length of said print image, and LBE represents a trailing blank length defined as a length of said blank image extending from said trailing edge of said main image to said trailing edge of said print image, then feeding said tape by a length of LD+LBE, and then carrying out said trailing end-cutting operation.

11. A method according to claim 4, wherein the step of carrying out said leading end-cutting control process includes, if said ground image is set to said background image of said present label, carrying out said extra printing operation over said leading extra print length LAS, then carrying out said main printing operation over a length of said head-to-cutter distance LD from said leading edge of said print image, and then carrying out said leading end-cutting operation.

12. A method according claim 4, wherein the step of controlling said operation of said feeder device and said operation of said print head and at the same time controlling said operation of said cutter includes omitting said main printing operation over a leading blank length LBS defined as a length of said blank image extending from said leading edge of said print image to said leading edge of said main image, if said blank image is set to said background image of said present label.

13. A method according to claim 12, wherein the step of carrying out said leading end-cutting control process includes, if said blank image is set to said background image of said present label, carrying out said main printing operation over a length of LD−LBS from said leading edge of said main image, and then carrying out said leading end-cutting operation on condition that the relationship of said head-to-cutter distance LD, said extra print length LA, and said leading blank length LBS satisfies a condition of LD−LA>LBS.

14. A method according to claim 12, wherein the step of carrying out said leading end-cutting control process includes, if said blank image is set to said background image of said present label, and at the same time said ground image was set to said background image of said immediately preceding label, feeding said tape by a length of LA+LBS−LD, then carrying out said main printing operation over a length of LD−LBS from said leading edge of said main image, and then carrying out said leading end-cutting operation, on condition that the relationship of said head-to-cutter distance LD, said extra print length LA, and said leading blank length LBS satisfies a condition of LD−LA LBS<LD.

15. A method according to claim 12, wherein the step of carrying out said leading end-cutting control process includes, if said blank image is set to said background image of said present label, and at the same said ground image was set to said background image of said immediately preceding label, feeding said tape by said extra print length LAS, and then carrying out said leading end-cutting operation, on condition that the relationship of said head-to-cutter distance LD and said leading blank length LBS satisfies a condition of LD LBS.

16. A method according to claim 12, wherein the step of carrying out said leading end-cutting control process includes, if said blank image is set to said background image of said present label, and at the same time said blank image was set to said background image of said immediately preceding label, carrying out said main printing operation over a length of LD−LBS from said leading edge of said main image, and then carrying out said leading end-cutting operation, on condition that the relationship of said head-to-cutter distance LD and said leading blank length LBS satisfies a condition of LD>LBS.

17. A method according to claim 12, including the step of omitting said leading end-cutting control process, on condition that the relationship of said head-to-cutter distance LD and said leading blank length LBS satisfies a condition of LD LBS if said blank image is set to said background image of said present label and at the same time said blank image was set to said background image of said immediately preceding label.

18. A method according to claim 1, wherein said tape includes an adhesive layer allowing a portion of said tape cut off by said leading edge-cutting operation and said trailing end-cutting operation to be attached to a desired object.

19. A method according to claim 1, wherein said print image is printed by an ink jet printing method.

20. A method according to claim 1, wherein said print image is printed by decomposing said print image into a plurality of basic colors, said plurality of basic colors including three primary colors.

21. A method according to claim 20, wherein said plurality of basic colors further include a basic color corresponding to a mixed color of said three primary colors.

* * * * *